US012121141B2

(12) United States Patent
Schreiber et al.

(10) Patent No.: US 12,121,141 B2
(45) Date of Patent: Oct. 22, 2024

(54) COSMETIC APPLICATOR

(71) Applicant: L'Oreal, Paris (FR)

(72) Inventors: Camille Schreiber, Clichy (FR); Audrey Thenin, Clichy (FR)

(73) Assignee: L'Oreal, Paris (FR)

( * ) Notice: Subject to any disclaimer, the term of this patent is extended or adjusted under 35 U.S.C. 154(b) by 5 days.

(21) Appl. No.: 16/644,016

(22) PCT Filed: Sep. 12, 2018

(86) PCT No.: PCT/EP2018/074648
§ 371 (c)(1),
(2) Date: Mar. 3, 2020

(87) PCT Pub. No.: WO2019/053081
PCT Pub. Date: Mar. 21, 2019

(65) Prior Publication Data

US 2020/0245752 A1 Aug. 6, 2020

(30) Foreign Application Priority Data

Sep. 12, 2017 (FR) ..... 1758404

(51) Int. Cl.
*A46B 9/02* (2006.01)
*A45D 40/26* (2006.01)
(Continued)

(52) U.S. Cl.
CPC ..... *A46B 9/021* (2013.01); *A45D 40/265* (2013.01); *A46B 3/18* (2013.01); *A46D 1/0238* (2013.01);
(Continued)

(58) Field of Classification Search
CPC ... A46B 9/021; A46B 3/18; A46B 2200/1053; A46B 3/005; A46B 9/028; A45D 40/265;
(Continued)

(56) References Cited

U.S. PATENT DOCUMENTS 422,117 A * 2/1890 Christoffel ..... F41A 29/02 15/104.19
722,714 A * 3/1903 Kahn ..... A45D 24/02 132/161
(Continued)

FOREIGN PATENT DOCUMENTS

CA 2300665 A1 9/2000
CN 1317946 A * 10/2001 ..... A46B 9/021
(Continued)

OTHER PUBLICATIONS

Kerman E, "FR-3011168-A1_Abstract_translate" (Year: 2015).*
(Continued)

*Primary Examiner* — Jacqueline T Johanas
*Assistant Examiner* — Holly T. To
(74) *Attorney, Agent, or Firm* — Shumaker, Loop & Kendrick, LLP

(57) ABSTRACT

Applicator for applying a cosmetic composition to the eyelashes or eyebrows, including a core, at least one element attached to the core, each element including a central part fitted onto the core and at least one application member carried by the central part, this application member comprising a strand of material comprising at least one elbow that defines a composition collection surface.

14 Claims, 10 Drawing Sheets

(51) Int. Cl.
*A46B 3/18* (2006.01)
*A46D 1/00* (2006.01)

(52) U.S. Cl.
CPC ..... *A46D 1/0253* (2013.01); *A46D 1/0292* (2013.01); *A46B 2200/1053* (2013.01)

(58) Field of Classification Search
CPC .. A45D 40/262; A45D 34/042; A45D 34/045; A45D 24/02; A45D 8/12; A45D 40/264; A46D 1/0238; A46D 1/0253; A46D 1/0292; A46D 1/0269
USPC ..... 132/200, 218; D4/136, 128
See application file for complete search history.

(56) References Cited

U.S. PATENT DOCUMENTS 731,575 A 6/1903 Johnston
735,643 A * 8/1903 Winn ..... A45D 24/02 132/106
739,898 A * 9/1903 Montain ..... A45D 8/12 132/157
748,420 A * 12/1903 Richardson ..... A45D 8/12 132/157
864,124 A * 8/1907 Dunbar ..... A45D 8/12 132/157
912,355 A 2/1909 Becken
1,074,893 A * 10/1913 Pearce ..... A45D 8/12 132/141
1,094,013 A 4/1914 Peterson
1,179,426 A * 4/1916 Hamilton ..... A46B 9/04 15/207.2
1,433,238 A * 10/1922 Schulz ..... A45D 8/06 132/280
1,488,362 A * 3/1924 Sida, Jr. ..... A45D 24/30 132/125
1,824,665 A * 9/1931 Ehrlich ..... A45D 24/02 132/149
2,185,286 A * 1/1940 Whyte ..... A45D 8/12 132/157
2,196,815 A * 4/1940 Sawyer ..... A45D 8/12 132/141
2,299,770 A * 10/1942 Solomon ..... A45D 8/12 132/157
2,329,361 A * 9/1943 Solomon ..... A45D 8/12 132/157
2,348,339 A * 5/1944 Golden ..... A45D 24/02 132/901
2,372,080 A * 3/1945 Hahn ..... A45D 8/12 132/157
2,395,002 A * 2/1946 Kemmer ..... A45D 24/02 132/160
2,446,781 A * 8/1948 Norin ..... A45D 8/12 132/157
2,450,448 A * 10/1948 Sawyer ..... B29C 67/00 264/328.8
2,478,872 A * 8/1949 Leblanc ..... B29D 21/00 264/DIG. 66
2,479,631 A * 8/1949 Liebert ..... A45D 8/12 132/129
2,506,297 A * 5/1950 Goodman ..... A45D 8/12 132/129
2,508,799 A * 5/1950 Reis, Jr. ..... A46D 1/0238 15/207.2
2,551,131 A * 5/1951 Iesersek ..... A45D 24/04 132/154
2,559,940 A * 7/1951 Cartheuser ..... A45D 8/12 132/156
2,566,965 A 9/1951 Shaw
2,574,891 A * 11/1951 Sawyer ..... A45D 8/12 132/157
2,577,098 A * 12/1951 Wood ..... A45D 8/12 D28/32
2,596,296 A * 5/1952 Shields ..... A45D 24/24 33/8
2,599,191 A * 6/1952 Meunier ..... A46B 9/005 15/186
2,633,591 A * 4/1953 Servilla ..... A45D 24/18 132/157
2,669,239 A * 2/1954 Smith ..... A45D 8/12 24/546
2,689,968 A * 9/1954 Rissler ..... A46B 15/00 15/159.1
2,763,104 A * 9/1956 Lindenborg ..... B24D 13/10 15/207.2
2,763,895 A * 9/1956 Iesersek ..... A45D 24/04 264/138
D179,923 S * 3/1957 Moosa ..... D28/32
2,806,476 A * 9/1957 Thompson ..... A45D 8/12 132/901
2,814,302 A * 11/1957 Goodwin ..... A42B 5/00 D28/32
2,844,154 A * 7/1958 Solomon ..... A45D 8/12 D28/32
2,915,071 A 12/1959 Watkins
3,120,852 A * 2/1964 Sawyer ..... A45D 8/12 132/156
3,214,777 A * 11/1965 Kutik ..... A46B 1/00 15/207.2
3,256,545 A * 6/1966 Lewis, Jr. ..... A46D 1/0238 15/207.2
3,459,199 A * 8/1969 Connell ..... A45D 24/10 132/119.1
3,575,183 A * 4/1971 Tanner, Sr. ..... A45D 24/02 D28/21
3,750,680 A * 8/1973 Miller ..... A45D 24/007 132/119.1
3,872,873 A * 3/1975 Tupper ..... A45D 24/00 132/159
4,030,845 A * 6/1977 Deckert ..... A46B 11/00 401/268
4,211,217 A * 7/1980 Gueret ..... A46B 3/20 15/186
4,341,231 A * 7/1982 Costa ..... A45D 34/04 132/218
4,406,032 A * 9/1983 Diamant ..... A46D 1/00 15/207.2
4,461,312 A * 7/1984 Gueret ..... A46B 1/00 132/218
4,493,126 A * 1/1985 Uy ..... B44D 3/162 15/236.08
4,504,998 A * 3/1985 Price ..... A46D 1/00 15/186
4,522,215 A * 6/1985 Verducci ..... A45D 8/12 132/219
4,561,456 A * 12/1985 Gueret ..... B29C 45/2626 15/207.2
4,616,374 A * 10/1986 Novogrodsky ..... A46B 9/04 15/207.2
4,619,012 A * 10/1986 Wachtel ..... A46B 7/04 15/207.2
4,753,252 A * 6/1988 Boxer ..... A45D 8/24 132/279
5,152,306 A * 10/1992 Stephan ..... A45D 24/02 132/219
5,191,670 A * 3/1993 Lake ..... A46D 1/00 15/207.2
D341,718 S * 11/1993 Briganti ..... D4/133
D345,440 S * 3/1994 Van Dyk ..... D28/29
5,386,839 A * 2/1995 Chen ..... A46B 7/02 132/160
5,657,775 A * 8/1997 Chou ..... A46B 9/023 15/207.2
5,694,953 A * 12/1997 Stephan ..... A45D 24/00 132/270
5,761,760 A 6/1998 Dumler et al.
5,816,267 A * 10/1998 Chou ..... A45D 24/06 132/148

(56) References Cited

U.S. PATENT DOCUMENTS 5,881,426 A * 3/1999 Tong ..... A46B 9/023 15/207.2
5,926,904 A * 7/1999 Warner ..... A46B 13/001 15/198
6,016,815 A * 1/2000 Christoforou ..... A45D 40/265 132/218
6,045,911 A * 4/2000 Legrand ..... A01D 34/4168 30/356
6,086,373 A 7/2000 Schiff et al.
6,141,818 A * 11/2000 Weihrauch ..... D02G 1/14 15/207.2
D453,076 S * 1/2002 Naghibi ..... D4/136
6,343,607 B1 * 2/2002 Gueret ..... A45D 40/265 132/218
6,412,496 B1 * 7/2002 Gueret ..... A45D 40/267 15/207.2
6,450,177 B1 * 9/2002 Christoforu ..... A46D 1/00 132/218
6,616,366 B1 9/2003 Weihrauch
6,668,841 B1 * 12/2003 Chou ..... A45D 8/24 132/278
RE38,397 E 1/2004 Gueret
6,823,874 B2 * 11/2004 Lexcen ..... A45D 24/02 132/126
6,866,046 B2 * 3/2005 Gueret ..... A46B 9/021 132/218
7,481,228 B2 * 1/2009 Ragosta ..... A45D 2/001 132/238
7,497,218 B2 * 3/2009 Gueret ..... A45D 2/48 132/217
D591,955 S * 5/2009 Kulik ..... D4/136
7,654,270 B2 * 2/2010 Gueret ..... A46D 1/0253 15/207.2
7,992,577 B2 * 8/2011 De Brouwer ..... A45D 34/045 132/218
8,091,562 B2 1/2012 Manici et al.
8,205,624 B2 * 6/2012 Gueret ..... A46B 9/021 132/218
8,210,763 B2 * 7/2012 Gueret ..... A45D 40/265 401/129
8,336,560 B2 12/2012 Dumler et al.
8,361,095 B2 * 1/2013 Osborne ..... A61B 17/320725 606/159
D677,904 S 3/2013 Hammer
8,438,689 B2 * 5/2013 Noble ..... A46D 1/02 15/171
8,474,086 B1 * 7/2013 Smith ..... A46B 13/001 15/207.2
8,568,049 B2 10/2013 Kulik
8,794,247 B2 * 8/2014 Kulik ..... A46B 9/06 15/207.2
8,899,241 B2 * 12/2014 Vandromme ..... A46B 9/021 15/187
8,905,050 B2 12/2014 Gueret
8,919,351 B1 * 12/2014 Wang ..... A46B 9/021 132/218
9,254,028 B2 * 2/2016 Gueret ..... A46D 1/0238
D757,445 S 5/2016 Rutigliano et al.
D757,455 S 5/2016 Rutigliano et al.
9,370,234 B2 * 6/2016 Lhoyer ..... A46D 3/005
9,420,874 B2 8/2016 Castex et al.
9,427,075 B2 * 8/2016 Gueret ..... A45D 40/267
9,591,916 B2 3/2017 Kim
10,278,478 B2 * 5/2019 Sanchez ..... A45D 40/265
10,299,565 B2 * 5/2019 Sanchez ..... A46B 1/00
10,849,415 B2 * 12/2020 De Bardonneche ... A46B 9/028
10,973,312 B2 * 4/2021 Pires ..... A46B 9/005
2001/0035191 A1 * 11/2001 Lee ..... A46D 1/00 132/901
2002/0020424 A1 2/2002 Gueret
2002/0138929 A1 * 10/2002 Mehta ..... A46D 1/0292 601/129
2003/0150075 A1 * 8/2003 Montoli ..... A46B 9/021 15/206
2003/0163884 A1 9/2003 Weihrauch
2003/0213498 A1 * 11/2003 Gueret ..... A46B 9/028 132/218
2003/0230317 A1 * 12/2003 Montoli ..... A46D 1/0238 132/218
2004/0244809 A1 * 12/2004 Gueret ..... A46D 1/00 132/218
2005/0160546 A1 * 7/2005 Weihrauch ..... B29C 45/34 428/397
2005/0285439 A1 * 12/2005 Kubaitis ..... A46D 1/0284 15/207.2
2006/0054179 A1 * 3/2006 Kuzuu ..... A46B 9/021 132/218
2006/0056903 A1 * 3/2006 Gueret ..... A45D 40/267 401/122
2006/0070635 A1 * 4/2006 Dumler ..... A46D 1/0238 15/187
2006/0236484 A1 * 10/2006 Lee ..... A46D 1/0253 15/167.1
2007/0034223 A1 * 2/2007 Dumler ..... A45D 40/262 132/218
2007/0062552 A1 * 3/2007 De Brouwer ..... A45D 34/045 132/218
2008/0142034 A1 * 6/2008 Manici ..... A45D 40/262 132/218
2008/0219748 A1 * 9/2008 Salciarini ..... A46D 1/08 401/129
2009/0133707 A1 * 5/2009 Gueret ..... A45D 40/265 401/121
2009/0193602 A1 8/2009 Dumler et al.
2009/0194128 A1 * 8/2009 Vandromme ..... A46B 9/021 132/218
2009/0211047 A1 8/2009 Chen
2010/0037911 A1 * 2/2010 Kim ..... A46B 9/021 132/218
2010/0071715 A1 3/2010 Bickford
2010/0310295 A1 * 12/2010 Gueret ..... A46B 1/00 401/122
2011/0041867 A1 * 2/2011 Hsu ..... A45D 8/36 132/276
2011/0229246 A1 * 9/2011 Kulik ..... A46D 1/0292 401/129
2012/0090635 A1 * 4/2012 Hsu ..... A45D 8/38 132/275
2012/0167910 A1 7/2012 Weigel
2012/0192892 A1 8/2012 Kulik
2013/0000663 A1 * 1/2013 Jacob ..... A46B 9/021 15/207.2
2013/0055518 A1 * 3/2013 Jacob ..... A46B 9/025 15/160
2013/0133692 A1 * 5/2013 Withers ..... A46B 13/001 134/6
2014/0003857 A1 * 1/2014 Gueret ..... A45D 40/262 132/218
2014/0016985 A1 * 1/2014 Osvaldo ..... A46D 1/0253 401/129
2014/0105667 A1 * 4/2014 Castex ..... A46B 9/021 401/129
2015/0024080 A1 * 1/2015 Jacob ..... B29C 45/2626 425/542
2015/0071695 A1 3/2015 Kamm
2015/0335133 A1 * 11/2015 Kim ..... A46B 9/021 401/118
2016/0022012 A1 * 1/2016 Jacob ..... A46B 3/005 401/129
2016/0023388 A1 * 1/2016 Jacob ..... A46D 1/0261 425/542
2016/0073767 A1 * 3/2016 Sanchez ..... A45D 40/265 401/129
2016/0143419 A1 5/2016 Sanchez et al.
2016/0295996 A1 10/2016 Rutigliano et al.
2016/0360859 A1 12/2016 Uresti et al.
2017/0000242 A1 * 1/2017 Jacob ..... A45D 40/267
2017/0238678 A1 * 8/2017 Manici ..... A45D 40/267

(56) References Cited

U.S. PATENT DOCUMENTS

| | | | | |
|---|---|---|---|---|
| 2017/0290291 | A1* | 10/2017 | Moeller | A46D 1/0253 |
| 2017/0290412 | A1* | 10/2017 | Pires | A46B 9/028 |
| 2018/0008028 | A1* | 1/2018 | Kim | A46B 7/044 |
| 2018/0242714 | A1* | 8/2018 | De Bardonneche | A46B 1/00 |
| 2018/0295965 | A1 | 10/2018 | Buck, Jr. et al. | |
| 2021/0030130 | A1* | 2/2021 | Kelly | A45D 2/2471 |
| 2021/0169210 | A1* | 6/2021 | Chu | A46D 1/0276 |
| 2021/0186183 | A1 | 6/2021 | Crapet | |

FOREIGN PATENT DOCUMENTS

| | | | | | |
|---|---|---|---|---|---|
| CN | 1868369 | A | * | 11/2006 | A45D 40/267 |
| CN | 101496673 | A | * | 8/2009 | A46B 9/021 |
| CN | 102525090 | A | | 7/2012 | |
| DE | 202011050794 | U1 | | 9/2011 | |
| DE | 20201001472 | U1 | | 1/2012 | |
| DE | 202010014792 | U1 | * | 1/2012 | A46B 7/042 |
| DE | 202010017159 | U1 | * | 4/2012 | |
| EP | 0038524 | A2 | | 10/1981 | |
| EP | 0103205 | A1 | * | 3/1984 | A46D 1/00 |
| EP | 0250680 | A1 | * | 1/1988 | A46D 1/0246 |
| EP | 0717944 | A1 | * | 6/1996 | A46B 3/18 |
| EP | 1034722 | A2 | * | 9/2000 | A45D 40/265 |
| EP | 1767118 | A1 | * | 3/2007 | A45D 40/262 |
| EP | 2005857 | A1 | | 12/2008 | |
| EP | 2196106 | A1 | * | 6/2010 | A46B 9/021 |
| EP | 2281478 | A2 | | 2/2011 | |
| EP | 2389833 | A2 | * | 11/2011 | A46D 1/0207 |
| FR | 2900319 | A1 | | 11/2007 | |
| FR | 2906692 | A1 | | 4/2008 | |
| FR | 3011168 | A1 | * | 4/2015 | A46B 9/021 |
| FR | 3032869 | A1 | * | 8/2016 | A46B 9/021 |
| WO | WO-0158309 | A1 | * | 8/2001 | A46B 9/021 |
| WO | WO-02056726 | A2 | * | 7/2002 | |
| WO | WO-2010013213 | A2 | * | 2/2010 | |
| WO | WO-2010067314 | A1 | * | 6/2010 | |
| WO | WO-2011013098 | A1 | * | 2/2011 | |
| WO | 2012123675 | A1 | | 9/2012 | |
| WO | WO-2012137134 | A1 | * | 10/2012 | |
| WO | 2014195914 | A1 | | 12/2014 | |
| WO | WO-2015110853 | A1 | * | 7/2015 | |
| WO | WO-2016027251 | A1 | * | 2/2016 | A45D 2/002 |
| WO | 2016055649 | A1 | | 4/2016 | |
| WO | 2017098134 | A1 | | 6/2017 | |
| WO | 2020127707 | A1 | | 6/2020 | |
| WO | 2020127756 | A1 | | 6/2020 | |

OTHER PUBLICATIONS

Misselhorn, "DE_202010017159_U1_I_translated" (Year: 2012).*
Non-Final Office Action for U.S. Appl. No. 16/644,027 mailed Nov. 23, 2021 (28 pages).
Non-Final Office Action for U.S. Appl. No. 16/643,718 mailed Nov. 22, 2021 (12 pages).
Non-Final Office Action for U.S. Appl. No. 16/644,080 mailed Oct. 12, 2021 (23 pages).
English Translation and Office Action for Chinese Pat. Application No. 201880059372.8, mailed Feb. 9, 2021 (13 pages).
International Search Report (ISR) for PCT/EP2018/074643 mailed Oct. 4, 2018 (4 pages).
Written Opinion of the International Searching Authority for PCT/EP2018/074643 mailed Oct. 4, 2018 (5 pages).
International Search Report (ISR) for PCT/EP2018/074648 mailed Oct. 4, 2018 (4 pages).
Written Opinion of the International Searching Authority for PCT/EP2018/074648 mailed Oct. 4, 2018 (5 pages).
International Search Report (ISR) for PCT/EP2018/074652 mailed Oct. 4, 2018 (4 pages).
Written Opinion of the International Searching Authority for PCT/EP2018/074652 mailed Oct. 4, 2018 (5 pages).
International Search Report (ISR) for PCT/EP2018/074641 mailed Oct. 4, 2018 (4 pages).
Written Opinion of the International Searching Authority for PCT/EP208/074641 mailed Oct. 4, 2018 (5 pages).
International Search Report (ISR) for PCT/EP2018/074656 mailed Oct. 8, 2018 (4 pages).
Written Opinion of the International Searching Authority for PCT/EP2018/074656 mailed Oct. 8, 2018 (6 pages).
Final Rejection for U.S. Appl. No. 16/644,080 mailed Feb. 8, 2022 (30 pages).
Non-Final Office Action for U.S. Appl. No. 16/644,027 mailed Apr. 8, 2022 (26 pages).
Non-Final Office Action for U.S. Appl. No. 16/644,069 mailed Mar. 7, 2022 (30 pages).
Final Rejection for U.S. Appl. No. 16/644,069 mailed Sep. 7, 2022 (29 pages).
Final Rejection for U.S. Appl. No. 16/644,027 mailed Sep. 2, 2022 (20 pages).
Non-Final Office Action for U.S. Appl. No. 16/644,080 mailed Jul. 7, 2022 (23 pages).
Final Rejection for U.S. Appl. No. 16/643,718 mailed Jun. 29, 2022 (14 pages).
De Bardonneche "FR 3032869 A1_translated" (Year: 2016) (6 pages).
Final Rejection (FR) for U.S. Appl. No. 16/644,080, mailed Jan. 31, 2023 (34 pages).
Non-Final Office Action (NFOA) issued for U.S. Appl. No. 16/643,718 mailed Jan. 3, 2023 (21 pages).
Non-Final Office Action (NFOA) issued for U.S. Appl. No. 16/644,069 mailed Mar. 15, 2023 (40 pages).
Liaw et al., "Plastic Deformation", 2009, ScienceDirect (Year: 2009) (11 pages).
Non-Final Office Action (NFOA) for U.S. Appl. No. 16/644,027, mailed Dec. 28, 2022 (29 pages).
Non-Final Office Action (NFOA) for U.S. Appl. No. 16/643,718, mailed Jan. 3, 2023 (21 pages).
Dictonary.com, Cross Definition, 2002 (Year: 2002).
Final Rejection (FR) issued for U.S. Appl. No. 16/644,027 mailed Aug. 21, 2023 (28 pages).
Non-Final Office Action (NFOA) issued for U.S. Appl. No. 16/644,080 mailed Jul. 19, 2023 (42 pages).
Final Rejection issued for U.S. Appl. No. 16/643,718 mailed Jul. 21, 2023 (25 pages).
Final Rejection for U.S. Appl. No. 16/644,069, mailed Sep. 29, 2023 (47 pages).
Botto Paolo "EP-2196106-A1-translated" (Year: 2010).
Marcia Sue taylor "Alaska Native Artificates; Eskimos and Aleuts of the Bering Sea Rhythm of the Sea Collection" (Year: 2017).
Non-Final Office Action issued for U.S. Appl. No. 16/644,027, mailed Jan. 22, 2024 (30 pages).
Non-Final Office Action (NFOA) issued for U.S. Appl. No. 16/643,718 mailed Dec. 5, 2023 (24 pages).
Supplemental Notice of Allowability issued for U.S. Appl. No. 16/644,069, mailed May 20, 2024 (2 pages).
Notice of Allowance (NOA) issued for U.S. Appl. No. 16/644,069, mailed May 1, 2024 (10 pages).
Final Rejection (FR) issued for U.S. Appl. No. 16/644,027, mailed Aug. 6, 2024 (29 pages).

* cited by examiner

COSMETIC APPLICATOR

TECHNICAL FIELD AND BACKGROUND

The present invention relates to applicators for applying a cosmetic composition to the eyelashes or eyebrows, comprising an applicator part made up of a core and a plurality of elements attached to the core, each element comprising a central part fitted onto the core and at least one application member carried by the central part.

The patent U.S. Pat. No. 8,899,241 B2 discloses a first applicator of this type. The core is constituted for example by a metal hairpin folded on itself and twisted, or by a shaft of non-circular cross section, the central part being passed through by one or more openings with corresponding shapes.

The patent U.S. Pat. No. 9,591,916 B2 discloses further examples of applicators of this type, the central parts being in the form of disks that can be produced with complementary reliefs which allow them to be positioned with a mutually predefined angular orientation. The application members are constituted of simple spikes or, in a variant, of spikes that have short offshoots about a third of the way along their length. In further variants, the application members are in the form of tabs, the thickness of which decreases in the direction of the radially outer edge of the element, these tabs being flattened in one and the same plane as the central part. The tabs may be provided with concentric striations about the axis of the core, of small depth, or bosses or indentations of small size, forming a surface roughness.

There is a need to further improve applicators of this type, notably in order to have a good capacity for loading the eyelashes or eyebrows with cosmetic composition, while having satisfactory properties of combing and separating the eyelashes.

SUMMARY OF THE INVENTION

The invention aims to meet this need and achieves this aim by virtue of an applicator for applying a cosmetic composition to the eyelashes or eyebrows, comprising:

a core, at least one element attached to the core, each element comprising a central part fitted onto the core and at least one application member carried by the central part, this application member comprising a strand of material comprising at least one elbow that defines a composition collection surface.

This composition collection surface can be a groove that is open radially toward the outside of the element or in a circumferential direction or is oriented in some other way.

The choice of positioning of the groove can be made depending on the desired ease of access for the eyelashes to the composition retained in this groove, and depending on the desired degree of wiping.

The collection surface can also be a surface that is present in the distal half of the application member, for example defined by an arch present at the distal end of the application member. This collection surface can be set back, along the elongation axis, from the distal end of the application member, so as to retain product on passing through the wiping member.

Advantageously, the cosmetic composition intended to be applied to the eyelashes and/or eyebrows is a mascara composition. A mascara composition conventionally has a viscosity greater than 5 Pa·s, notably between 5 Pa·s and 50 Pa·s, at 25° C., in particular measured with the aid of a Rheomat RM100® machine.

Such a mascara composition conventionally comprises a solids content, generally in an amount greater than or equal to 35% by weight relative to the total weight of the composition, a pulverulent colorant, in particular one or more pigments, notably one or more metal oxides, for example one or more iron oxides, and advantageously a film-forming polymer. A mascara composition may also conventionally comprise one or more waxes, in a total amount of in particular between 5 and 40% by weight relative to the total weight of the composition.

In the scope of the present invention, the applicator is particularly suitable for applying a relatively thick or viscous mascara composition. This is because a mascara composition having a relatively high viscosity will be retained particularly well on the composition collection surface and will not run off this collection surface, or only run off a little, under its own weight.

The invention makes use of the fact that said elements can be produced separately so as to form reliefs thereon which would be difficult, if not impossible, to realize on conventional injection-molded brushes, in which the application members are molded in one piece of thermoplastic material with the core, on account of the problems associated with demolding. The invention thus makes it possible to form the abovementioned elbow with various shapes which are difficult, if not impossible, to realize on conventional injection-molded brushes.

In one particularly preferred embodiment, in accordance with the teaching of the document U.S. Pat. No. 8,899,241 B2 or its equivalent FR 2 900 319, the core has a longitudinal axis and each element is threaded onto the core along its longitudinal axis before the core is twisted, the core and the element, in particular the core and the central part of the element, being mechanically connected in order to substantially prevent the element from pivoting freely on the core.

Such a mechanical connection with no possibility of relative rotation of the core and the element(s) threaded onto the latter before twisting can be obtained by means of a core produced in the form of an elongate element that is made of plastically deformable material and has a non-circular (for example polygonal, such as square, rectangular, triangular, etc., oval, multilobed, etc.) cross section in the non-twisted state, said core being threaded through an orifice of complementary cross section provided in the central part of each of the elements.

In a variant, the core comprises two wires made of plastically deformable material, for example two metal wires, optionally joined together at one of their ends by being produced from a single wire folded into the form of a hairpin, and the mechanical connection with no possibility of relative rotation of the core and the element(s) threaded onto the latter before twisting is obtained by threading the wires of the core in the non-twisted state into two orifices, preferably with complementary shapes, provided in the central part of each of the elements.

The core carrying the element(s) is then twisted so as to obtain a helical spread of the application members along the longitudinal axis of the core. The expression "the core is twisted" means here that the core, carrying the element(s), is subjected to torsion, realized for example by imparting on one of its parts a rotational movement about the longitudinal axis of the core (for example in the clockwise direction), while the other parts of the core remain rotationally fixed, or are subjected to a movement in the opposite direction (for example in the counterclockwise direction). This torsional force is realized so as to impart a plastic deformation on the core, such that the latter takes on its twisted shape in a stable and definitive manner once this torsional force stops being exerted on it.

The present invention is not limited to just the above-described embodiments for ensuring the mechanical connection with no possibility of relative rotation between the core and the element, in particular between the core and the central part of the element, but rather extends to all technical equivalents known to a person skilled in the art for producing such a connection.

The invention makes it possible to collect composition at a certain radial distance from the central part, which is easily accessible for the eyelashes, and makes it possible to load them with composition without it being necessary to introduce them deeply into the applicator part.

The invention makes it possible as it were to "lift" the level of the composition on the applicator part, by affording surfaces suitable for the collection thereof at a certain radial distance from the central part.

An "elbow" should be understood as being a change in direction of a strand of material of which the application member is made, this strand being able to maintain a cross section which is substantially the same. The elbow is for example at a right angle or at an acute or obtuse angle. The strand of material can form a loop of closed contour, the application member then being hollow. The elbow can be formed at the meeting point of pointed arches that are concave toward the outside or convex toward the outside. In the case of arches that are convex toward the outside, a concavity defining a product collection surface can be formed at the elbow formed by the meeting of these arches. In the case of concave arches, the product collection surface can be formed by the concavity of the arches.

The strand of material can comprise at least a portion with a variable curvature. Preferably, the elbow is a portion of variable curvature.

The strand of material can comprise at least a slope discontinuity that forms the elbow.

The cavity of the application member, when it is hollow, makes it possible to collect product by surface tension and thus to increase the autonomy of the applicator and/or to increase the loading capacity of the applicator, without otherwise losing any capacity for separating and combing the eyelashes. This cavity preferably has a greatest dimension of at least 0.2 mm, better still at least 0.5 mm.

The application members can be produced easily with a shape suitable for separation and combing and in sufficient numbers to obtain a satisfactory makeup effect.

The invention makes it possible, if desired, to produce hollow and wide application members that are capable of being loaded with a relatively large amount of composition while retaining a certain amount of flexibility, by producing them with the aid of a strand of material which surrounds the abovementioned cavity, this strand preferably being contained in a plane.

The strand of material can be given any shape depending on the desired characteristics, and notably a constant or non-constant cross section around the perimeter of the cavity. The strand of material can be given a shape that is narrower in places, if need be, in order to confer greater flexibility thereon. The strand has a cross section of for example between 0.04 and 1 $mm^2$ around at least a quarter of the perimeter of the cavity that it delimits, better still at least half the perimeter, or even three quarters or all thereof. The presence of the cavity gives the hollow application members greater flexibility in order to pass the wiping member with which the container from which the composition is taken is equipped. The cross section of the strand of material may or may not be polygonal, for example square, or circular.

The greatest width of the, notably hollow, application members, measured perpendicularly to their elongation axis, is for example greater than or equal to 0.5 mm, being preferably between 0.5 and 5 mm, better still between 1 and 2 mm.

Preferably, the central part and the application members of an element are produced in one piece by molding thermoplastic material, notably from the same material. Each element which is mounted on the core can have between 4 and 24 application members.

The element may have hollow application members, the cavity of which has a closed contour, thereby helping to improve the mechanical integrity of the application member, since the latter can then be produced without a free strand of material.

It is thus possible to obtain application members which are both highly loadable with product and have a good capacity for combing and separating the eyelashes on account of their mechanical strength.

The fact that the applicator is produced with separate elements makes it possible to easily give the cavity of the hollow application members various shapes, and/or to form almost closed cavities of various shapes therebetween, the element being for example demolded along the axis of the central part, that is to say the general direction in which the core passes through the central part, this axis being able to be parallel to the axis of the cavity, which is the direction in which the cavity passes through the application member. If need be, notably when the axis of the cavity is oriented perpendicularly to a radius, demolding can be carried out with elastic deformation of the application member.

The cavity formed by a hollow application member can also be almost closed, that is to say that the strand of material which defines the cavity is interrupted over a short distance instead of extending through a closed loop. This distance is less than or equal to 0.3 mm, better still less than or equal to 0.2 mm, even better still less than or equal to 0.1 mm.

It is also possible, and this can be combined with the presence of hollow application members, to produce almost closed cavities on the applicator part, where the composition can collect, by adjusting the shape of the application members and the closeness thereof. Here too, the invention makes use of the fact that the presence of elements initially separate from the core makes it possible to produce them with shapes that are otherwise difficult, if not impossible to mold on a conventional injection-molded brush. Almost closed cavities should be understood as meaning that the adjacent application members are close together, at a non-zero radial distance from the central part, by a distance less than or equal to 0.3 mm, better still less than or equal to 0.2 mm, even better still less than or equal to 0.1 mm. The spacing is for example measured at at least 0.5 mm from the central part. For example, the adjacent application members have a succession of pointed arches which proceed from the core and define teeth, two of which are sufficiently close together for an almost closed cavity to be formed between the two application members by the portion thereof which extends from the teeth closest to the central part.

In exemplary embodiments, the hollow application member has a strand of material extending through a complete loop. This strand of material has for example a substantially constant cross section around the majority of the perimeter of the loop, or even around the entire perimeter of the loop.

This loop can extend entirely at a distance from the central part, and this can have the advantage of forming a reserve of product at a location relatively far away radially from the core, for example more than 3 mm from the surface of the central part, this constituting a significant difference compared with brushes produced by injection-molding plastics material with simple spikes, the reserve of product then being closed at the base of the spikes in these known brushes and not at a significant radial distance from the core.

In exemplary embodiments, the loop forms an enlarged head for the application member and is joined to the central part by a leg, which is notably less wide than said head. This enlarged head can be given a harpoon shape for example, with the additional advantage of improving the catching of the eyelashes on the applicator and thus the capacity for the applicator to control the eyelashes, notably in order to curl them, in the manner desired by the user. The leg may be a single-strand leg or, in a variant, a multi-strand leg. The height of the leg can be greater than that of the head, the height being measured along the elongation axis of the application member, this axis being preferably radial. The presence of a single-strand leg can confer greater flexibility on the application member when this is desired.

In variant embodiments, the application member has a base and a head that are linked by a stem that is narrower than the base and the head, the cavity extending preferably continuously from the base to the head. Such variants make it possible to benefit both from a cavity that is suitable for collecting a relatively large amount of composition and from reliefs on the application member that increase the capacity of catching the eyelashes and/or aim to further increase the loading of the application member with composition, at a predefined distance from the core.

In variant embodiments, the hollow application member has a strand of material extending through an incomplete loop closed by the central part. This can make it possible to give the application member a wider base, and thus greater stability, and to extend the cavity as far as the central part.

When the cavity of the hollow application member extends over the majority of the radial dimension of the application member, notably over more or less all of its height, apart from the thickness of the strand of material forming the loop, this tends to increase the amount of product which becomes housed in the application member and makes it possible to benefit from a reserve of product over more or less the entire height of the application member.

The width of the cavity, measured in the circumferential direction, that is to say perpendicularly to a median radius, may be constant or variable. When it varies, its variation can be chosen so as to collect more or less product at the desired distance from the core, depending on the desired makeup effect.

For example, the application member has a base and a head that are linked by a stem that is narrower than the base and the head. Product can thus collect in the cavity inside the base, the stem and the head, with less product collected at the stem within the cavity.

The head and the base may form between one another at least one groove that is open in the circumferential direction, being able to contribute toward the catching of the eyelashes, and also making it possible to collect product at a distance from the core on the application member, outside the cavity.

This groove may have a substantially flat bottom, notably oriented substantially radially, and facing edges that converge toward the opening of the groove, this being able to improve the retention of the composition in the groove.

In variant embodiments, the hollow application member is toothed at its periphery. The teeth are for example formed by a succession of pointed arches that are concave toward the outside. The application member is for example in the overall shape of a holly leaf. The teeth that are present at the periphery of the application member can promote the catching of the eyelashes and also form reliefs that are suitable for collecting product at a radial distance from the central part of the element.

In variant embodiments, the application member has two lateral arches linked by a top arch, the lateral arches and the top arch preferably forming teeth at their meeting point. These teeth can help to comb and separate the eyelashes. The top arch can be concave toward the outside, in which case the concavity formed by the top arch makes it possible to collect product at a radial distance from the central part. The lateral arches can be concave in the opposite direction to the cavity formed therebetween. The application member can have a shape which widens toward the outside, away from the central part.

In variant embodiments, the hollow application member is multilobed at its periphery, the lobes being for example formed by a succession of pointed arches that are convex toward the outside. The application member can notably in this case be in the shape of an arrowhead.

An applicator according to the invention can thus have one or more of the following characteristics, considered in isolation or in combination:

- the strand of material forms at least one concavity that is open toward the outside, notably radially toward the outside or in a circumferential direction, and situated at a non-zero radial distance from the central part;
- the strand of material describes, starting from the central part, a first elbow for forming an enlarged base, which is continued by a portion defining a groove;
- the groove is U-shaped;
- said portion is attached to an arch which forms the top of an enlarged head of the application member;
- the application member has a strand of material which describes at least one groove, and notably has a leg which is attached radially to the central part, a first elbow substantially at a right angle, a second elbow substantially at a right angle toward the outside, a third elbow substantially at a right angle toward the elongation axis of the leg, and a fourth elbow substantially at a right angle toward the outside, a distal portion of the application member being straight and eccentric with respect to the elongation axis of the leg;
- the application member has an enlarged head comprising two arches that form elbows at their meeting point, one of the arches defining a composition collection surface;
- the application member has a strand of material of toothed shape, comprising a succession of pointed arches that are concave toward the outside;
- the application member has two lateral arms that are joined at their end by an arch, forming elbows;
- the application member is in the shape of an arrowhead, comprising a strand of material comprising a succession of pointed arches that are convex toward the outside;
- the application member has the overall shape of a V with elbows at the ends of the V, the element preferably comprising an alternation of a first application member having the overall shape of a V with elbows oriented substantially perpendicularly to a median plane for the application member, and a second application member comprising elbows oriented toward the central part;

the application member has a strand of material bent in a V-shape, forming two arms that diverge radially toward the outside;

the application member has an X-shaped head joined to the central part by a radial arm;

the elongation axes of the application members of an element are coplanar;

at least one application member of an element is flattened in a plane, and notably each application member of one and the same element is flattened in a flattening plane common to all the application members of the element;

the application members of an element have their flattening plane oriented in a plane containing the axis of the central part.

A further subject of the invention is a packaging and application device comprising:

a container containing the composition to be applied, an applicator according to the invention.

A further subject of the invention is a method for the cosmetic treatment of the eyelashes and/or eyebrows, notably for making them up, comprising the step of applying a cosmetic composition to the eyelashes with the aid of an applicator according to the invention.

BRIEF DESCRIPTION OF THE DRAWINGS

The invention may be better understood from reading the following detailed description of nonlimiting exemplary embodiments thereof and from examining the appended drawing, in which.

DETAILED DESCRIPTION

Figure 1:
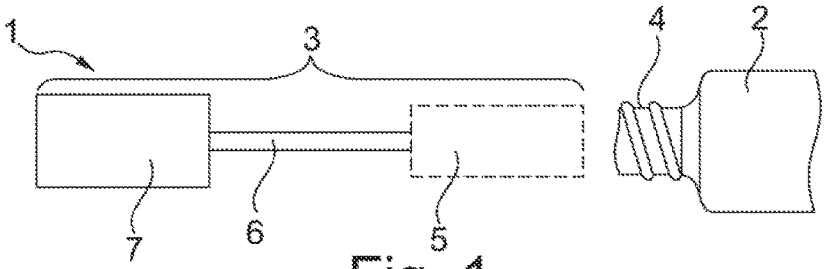
FIG. 1 shows a schematic and partial view of an example of a packaging and application device according to the invention.

The packaging and application device 1 shown schematically and partially in FIG. 1 has a container 2 containing the composition to be applied and an applicator 3 for applying this composition.

The container 2 has a body which is provided for example, as illustrated, with a threaded neck 4 to which the applicator 3 can be fastened when the device 1 is not being used.

A wiping member (not visible in the figure) is secured in the neck of the container, in the usual manner. It may be a flexible lip with a conical, wavy or other shape.

The applicator 3 has an applicator part 5 which is used for applying the composition, this applicator part 5 being mounted at one end of a stem 6, the other end of which is carried by a gripping member 7 that also constitutes, in the example in question, a closure member for the container 2, being designed to be fastened to the neck 4.

The composition which is applied may be constituted by any cosmetic product intended for making up or for caring for the eyelashes and/or eyebrows. Preferably, it is mascara. The composition may notably include pigments, such as iron oxides, dispersed in an aqueous or anhydrous medium. The capacity of the container is preferably between 5 and 30 ml.

Figure 2:
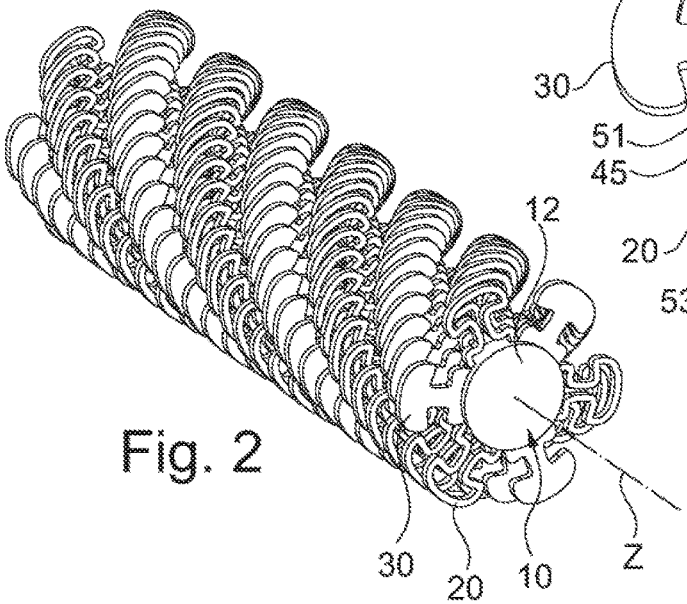
FIG. 2 shows the applicator part of an example of an applicator produced in accordance with the invention, on its own.
Figure 3:
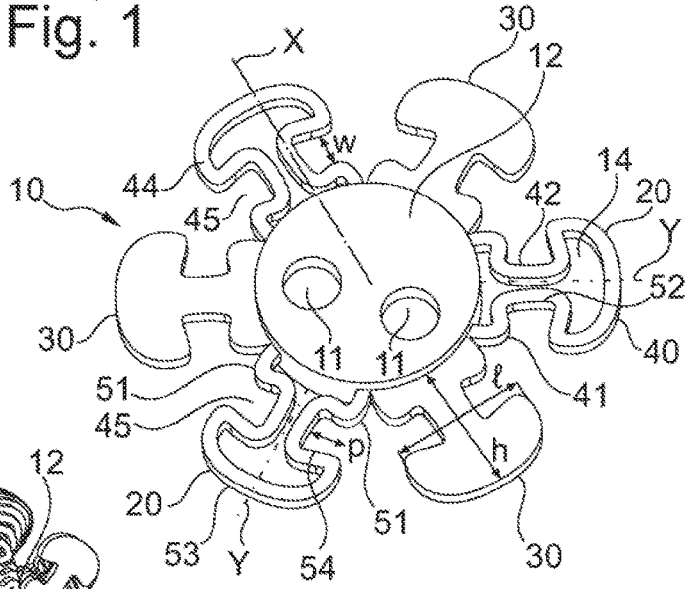
FIG. 3 shows an element used to produce the applicator part shown in FIG. 2, on its own.

FIG. 2 shows an example of an applicator part 5 produced from individual elements 10, one of which has been shown on its own in FIG. 3.

The applicator part 5 is preferably produced in accordance with the teaching of the patent U.S. Pat. No. 8,899,241 B2. The elements 10 are thus mounted on a core 9 that holds them in a stacked manner and securely relative to one another. This core 9 is for example a twisted core, produced from a metal wire folded into the form of a hairpin, as illustrated in FIG. 4.

Figure 4:
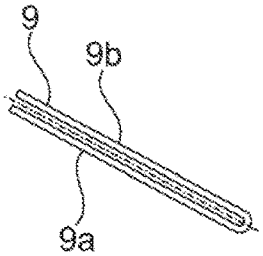
FIG. 4 shows an example of a core on which the elements can be mounted, the core being shown before the mounting of the elements and twisting.

In a variant, the core may be constituted by two separate metal wires that are positioned in a substantially parallel manner like the arms of the hairpin illustrated in FIG. 4, onto which the elements 10 are threaded and which are then twisted.

The elements 10 have holes 11, which are shown schematically in FIG. 3, for the arms 9*a* and 9*b* of the core to pass through before the latter is twisted.

For the sake of clarity of the drawing, the core 9 has not been shown in FIG. 2, and the holes 11 passing through the central part 12 are only shown in FIG. 3.

In the example in question, the elements 10 are identical, but it would not constitute a departure from the scope of the present invention if elements 10 of different shapes were stacked on the core 9 within the applicator part 5.

As can be seen in FIG. 3, each element 10 has hollow application members 20 which engage with the eyelashes or eyebrows while the applicator 3 is being used. In the example in question, these hollow application members 20 alternate circumferentially with solid application members 30.

The application elements 20 and 30 have, in this example, the same exterior shape, but it would not constitute a departure from the scope of the present invention if the exterior shapes were different.

The central part 12 is in the form of a flattened disk, the holes 11 for the arms 9*a*, 9*b* of the core 9 to pass through being disposed symmetrically relative to an axis X of the element 10, which may be an axis of symmetry for the central part 12.

In the example illustrated, the element 10 has three hollow application members 20 which alternate with three solid application members 30, the hollow application members 20 being disposed at 120 degrees to one another about the axis X of the element 10.

The application members 20 or 30 have an enlarged head 40 linked to a base 41 by a stem 42 that is less wide than the head and the base. The head 40 forms with the base 41, on the outside, a groove 45 on each side of the elongation axis Y of the application member 20. The head is wider than the base 41.

This elongation axis Y is, in the example illustrated, an axis of symmetry for the application member, and coincides with a radius.

The surface of the central part 12, to which the application members are joined, may be in the shape of a cylinder of revolution about the axis X, but further shapes are possible.

In the example illustrated, the application members 20 and 30 each have a flattened shape in a plane which is coincident with the flattening plane of the central part 12, this plane being perpendicular to the axis X and to the longitudinal axis Z of the applicator part 5.

The application members 20 and 30 substantially meet at their base, where they are joined to the central part 12.

The application members 20 are formed by a strand of material 44 which extends through a loop that is closed by the central part 12. More particularly, this strand of material 44 is joined to the central part 12, forming a first elbow 51, which forms one of the sides of the enlarged base 41. The strand 44 continues beyond the elbow 51 with a U-shaped portion 52 that defines the groove 45 on one side of the application member 20 and then continues in the form of an arch 53, convex toward the outside, which forms the top of the enlarged head 40 of the application member 20.

The enlarged head 40 has, on the opposite side from the arch 53, edges 54 which are oriented toward the axis Y and toward the arch 53. The groove 45 has edges that converge slightly toward the opening thereof, the bottom of the groove 45 being substantially flat for example, as illustrated.

The fact that the groove 45 is delimited by edges which converge away from the bottom thereof further improves the retention of the composition within said groove by the surface tension effect.

Each application member 20 or 30 has a relatively squat shape, with a height h, measured between the vertex of the application member and the central part, which is substantially of the same order of magnitude as the width l of the application member, measured perpendicularly to the elongation axis Y. For example, $0.5\ h \leq l \leq 2\ h$. For example, $1\ mm < l < 6\ mm$ and $2\ mm < h < 8\ mm$.

The cavity 14 defined inside the strand of material 44 makes it possible to collect the composition within the applicator part 5 in spite of the passage through the wiping member on exiting the container 2.

Product can also collect in the grooves 45 formed between the head and the base of the application members 20 and 30, this collection of composition taking place at a non-zero radial distance from the central part 12. It is thus easier for the eyelashes and eyebrows to access the composition, since they do not have to be introduced as far as the central part 12 to be loaded with composition.

The protruding parts formed by the lateral ends of the enlarged heads are suitable for catching the eyelashes, and this can improve the controlling thereof by the applicator part, in order for example to curl them or spread the composition over the surface thereof.

The relatively wide base of the application members 20 and 30 gives them good stability with respect to forces which can be exerted while the applicator part 5 is being used, notably on passing through the wiping member or for applying the composition to the eyelashes and eyebrows. The cavity 14 helps to confer flexibility for passing through the wiping member.

In order to produce the applicator part 2, the elements 10 are threaded onto the core 9 and then the latter is twisted, as per the teaching of the patent U.S. Pat. No. 8,899,241 B2. The number of elements 10 is for example between 2 and 100, better still between 5 and 15.

In order to manufacture the elements 10, they can be molded in a suitable mold such that demolding takes place along the axis X.

In such a case, the presence of the cavity 14 within the hollow application elements 20 does not hamper demolding in any way. In general, any thermoplastic material can be used to mold the elements 10, regardless of the shape of the central part 12 and of the application members joined thereto. It is possible notably to use a polyolefin or a thermoplastic elastomer, for example of the SEBS type.

It is also possible to produce the element 10 from a non-thermoplastic material, for example a metal or ceramic material.

During the twisting of the core, the elements 10 can undergo rotation relative to one another, such that a progressive angular offset is created between the elements, along the core, this being able, if appropriate, to create helical furrows in the applicator part 5.

If appropriate, it is possible to produce the central parts 12 with complementary reliefs which cooperate so as to make it easier to position one element 10 in a predefined angular position about the longitudinal axis of the core relative to the adjacent elements 10.

The depth p of the groove 45 is for example greater than or equal to 0.2 mm and the width w of the opening of the groove is for example between 0.2 and 3 mm.

The strand of material 44 can have a cross section which is substantially constant around the entire contour of the application member 20, between its ends that are joined to the central part 12. The cross section of the strand 44 is for example around 0.25 $mm^2$.

A first set of variant embodiments of application members and elements 10 having a hollow application members 20 will now be described with reference to FIGS. 5 to 12.

Figure 5:
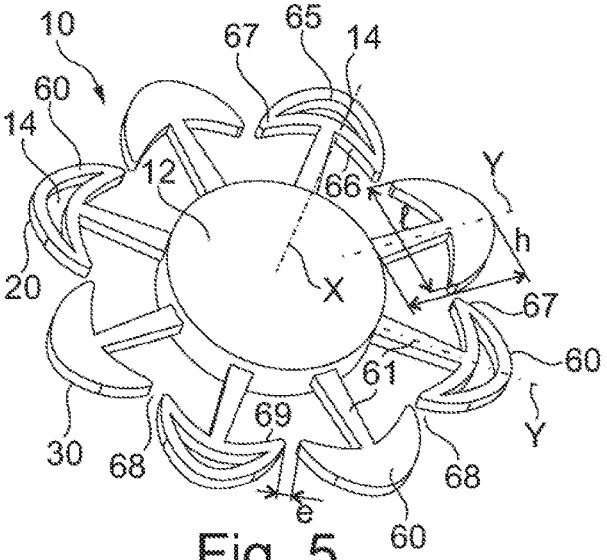
FIGS. 5 is similar to FIG. 3 of a variant embodiment of the element.
Figure 6:
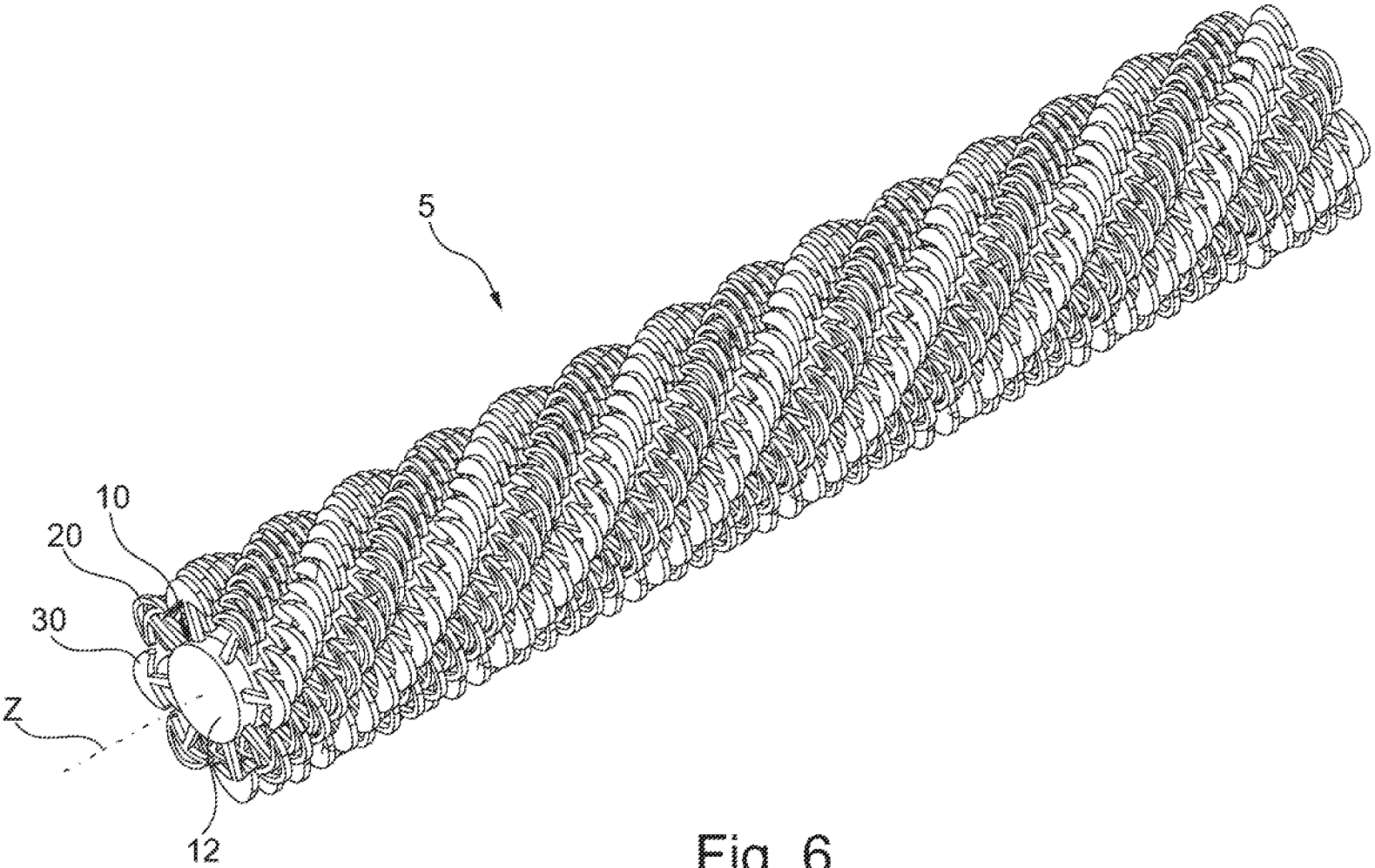
FIGS. 6 shows the applicator parts produced with the elements in FIG. 5.

In the variant in FIGS. 5 and 6, each element 10 has an alternation of hollow application members 20 and solid application members 30, there being four hollow application members 20 in the example in question, which are disposed at 90 degrees to one another.

The cavity 14 of each hollow application member 20 is formed by a strand of material 63 which describes a closed curve constituting an enlarged head 60, this loop being joined to the central part 12 by a leg 61.

In the example illustrated, the enlarged head 60 has the overall shape of a harpoon with a top arch 65, which has a substantially parabolic shape that is convex toward the outside, and a bottom arch 66, which is concave toward the central part 12 and has less of a curvature than the top arch 65. The bottom arch 66 and the top arch 65 meet, forming elbows 67. Product can notably collect on the outer surface of the top arches 65, in the recess formed between two adjacent heads. Product can also collect in the cavity 14, notably at the elbows or in the vicinity of the arches 65 and 66, thereby favoring the retention of product by surface tension.

The cavity 14 has a radial dimension which is at its maximum on the elongation axis Y and which decreases towards the meeting point between the arches 65 and 66.

At this meeting point, the enlarged head 60 defines teeth which are oriented in a direction away from the axis Y and toward the central part, this orientation helping to catch more of the eyelashes which are introduced into the applicator part 5.

In the example illustrated, the distance e between the enlarged heads 60 of two adjacent application members 20, 30 on the element 10 is relatively small and less than the distance between the legs 61 at their base. The enlarged heads 60 are thus relatively close together. This distance e may be between 0.1 and 0.3 mm, being large enough to allow an eyelash to pass into the space between two legs 61 under the enlarged heads 60.

When the spacing e is sufficiently small, that is to say less than or equal to 0.3 mm, better still less than or equal to 0.2 mm, even better still less than or equal to 0.1 mm, another cavity 69, which is almost closed, where the composition can also collect by surface tension, is formed between the application members 20 and 30. This almost closed cavity 69 extends as far as the central part 12 in the example in question.

In the same way as for the example in FIG. 3, it is possible to have a height h and a width l of the application member which satisfy the relationship $0.5\ h \leq l \leq 2\ h$.

FIG. 6 shows that the elements 10 can be disposed by being stacked and by forming helical furrows on account of the twisting of the core.

A variant embodiment of the applicator part 5 and of the elements 10 with which the latter is produced will now be described with reference to FIGS. 7 and 8. In the example in FIG. 7, the element 10 only has hollow application members 20, unlike the examples in FIGS. 3 and 5, where there is an alternation of application members of different natures in the circumferential direction.

All of the application members 20 are identical and each have a toothed shape with numerous of elbows which define a corresponding number of teeth on the outer side thereof. The cavities 14 are delimited by a strand of material 80 which describes a succession of pointed arches, which are concave toward the outside, teeth being formed at the meeting point between two arches. More particularly, in the example illustrated, the strand of material 80 describes, starting from the central part 12, a first pointed arch 81, which is joined to a second arch 82, forming a first tooth 86, this second arch 82 itself being joined to a third arch 83, forming a tooth 84.

Each application member 20 has a shape that is symmetric with respect to its elongation axis Y.

At their meeting point, the two arches 83 form a tooth 85, which defines the vertex of the hollow application member 20 and is situated on the elongation axis Y.

Each application member 20 thus has the overall shape of a holly leaf. In this example, the cavity 14 extends over substantially the entire height of the application member 20, less the thickness taken up by the strand of material 80. The height m of the cavity, measured along the elongation axis Y, that is to say along a radius in the example in question, is thus greater than or equal to half the height h. There is for example the following relationship between l and h $0.5\ h \leq l \leq 2\ h$, where l denotes the greatest transverse dimension of the application member, measured perpendicularly to the elongation axis Y.

Figure 7:
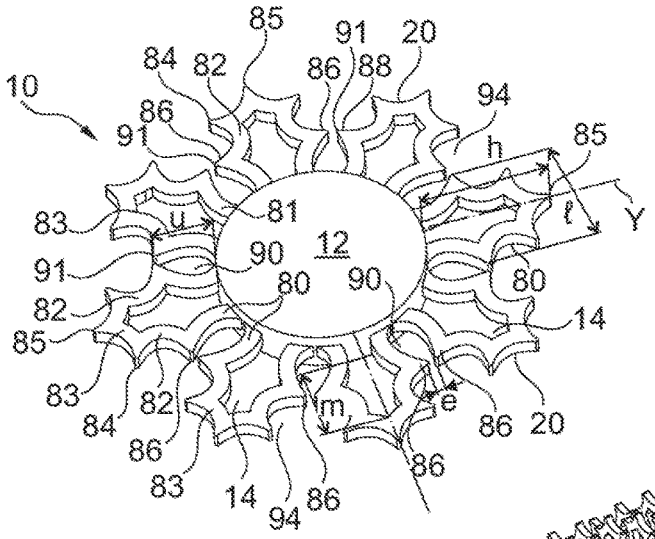
FIG. 7 is a view similar to FIG. 3 of variant embodiments of the element.

FIG. 7 shows that the gap e which exists between two adjacent application members, at the teeth 86, is relatively small and for example less than or equal to 0.3 mm, and may notably be between 0.1 and 0.3 mm.

In the example illustrated, the application members 20 substantially meet at their base, where the strands of material 80 are joined to the central part 12. The fact that the teeth 86 of the adjacent application members are relatively close together makes it possible to form, between the first arches 81 of two adjacent application members, reserves of product in a relatively confined space 90 which only communicates with the outside through a relatively narrow opening 91, of width e. The space 90 constitutes an almost closed cavity within the meaning of the invention, when the width e is less than or equal to 0.3 mm, better still less than or equal to 0.2 mm, even better still less than or equal to 0.1 mm.

The arches 82 which extend on either side of this narrow opening 91 define a space 94 in which the product can collect at a non-zero radial distance from the central part 12. The user thus has a reserve of product in this space 94, where the eyelashes can be introduced, while benefiting from teeth formed at the meeting point between the different arches in order to grip the eyelashes.

All of the concavities formed by the different arches form a corresponding number of indentations in which product can collect, thereby increasing the loading capacity of the applicator part 5.

The end arches 83 each define a cavity 89 that is open in a direction T that makes a relatively small angle y with the elongation axis Y, y being less than or equal to 30°, such that the cavity 89 is open substantially radially toward the outside. In the example illustrated, the direction T coincides with a median axis for the cavity 89, which is also the axis of symmetry for this cavity. The orientation of the cavity 89 makes it easier for the eyelashes to access the product that has collected inside. This access is even easier when the cavity 89 is present at the periphery of the applicator part 5, such that the eyelashes do not have to pass far into the applicator part in order to be loaded with product.

Figure 8:
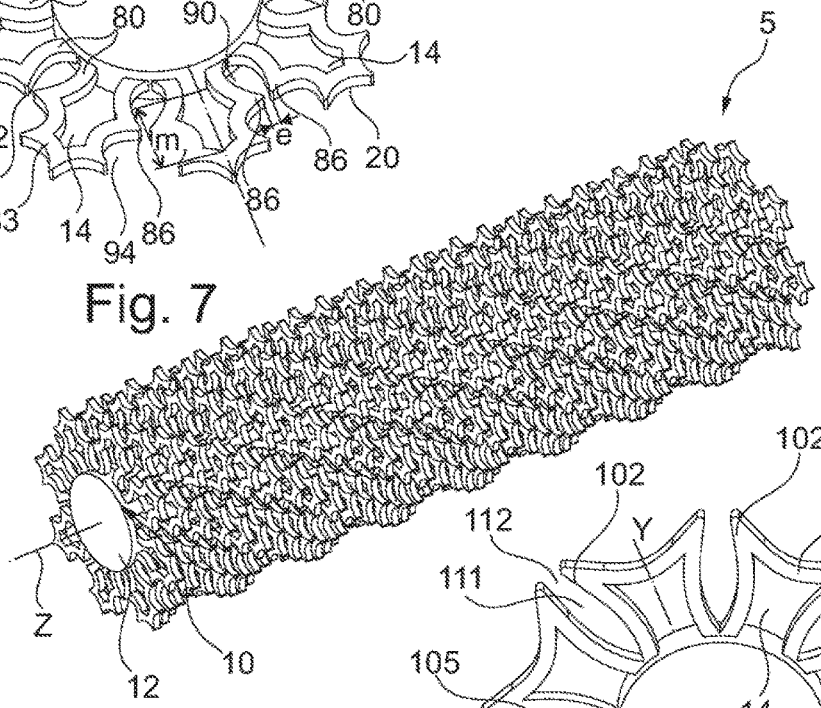
FIG. 8 shows the applicator parts produced with the elements in FIG. 7.

FIG. 8 shows that the elements 10 can be angularly offset about the longitudinal axis of the applicator part on account of the twisting of the core.

A variant embodiment of the applicator part 5 will now be described with reference to FIGS. 9 and 10.

In this example, the element 10 only has hollow application members 20 that define a corresponding number of cavities 14.

Each application member 20 is formed by two lateral arches 100 that are joined at their distal end by a top arch 101, the lateral arches 100 and the top arch 101 being concave toward the outside. The arches 100 and 101 form, at their meeting points elbows of which the outer sides define teeth 102. The application member 20 is formed by a strand of material 105.

The top arch 101 defines a cavity 109 that is open in a direction T which coincides with the elongation axis Y of the application member 20 and is also a median axis of symmetry for the application member 20.

The product can collect in the concavity of the top arch 101, the bottom of which is set back from the vertex of the teeth 102 along the elongation axis Y. Product can also collect in the cavity 14 formed by the strand of material 105. The facing lateral arches 100 of two adjacent application members 20 define a space 111 between one another, in which product can also collect. This space communicates with the outside through a narrow opening 112, this opening 112 leading out between the two teeth 102 of the two adjacent application members 20.

The fact that the opening 112 is narrow improves the retention of product between the hollow application members 20.

Figure 9:
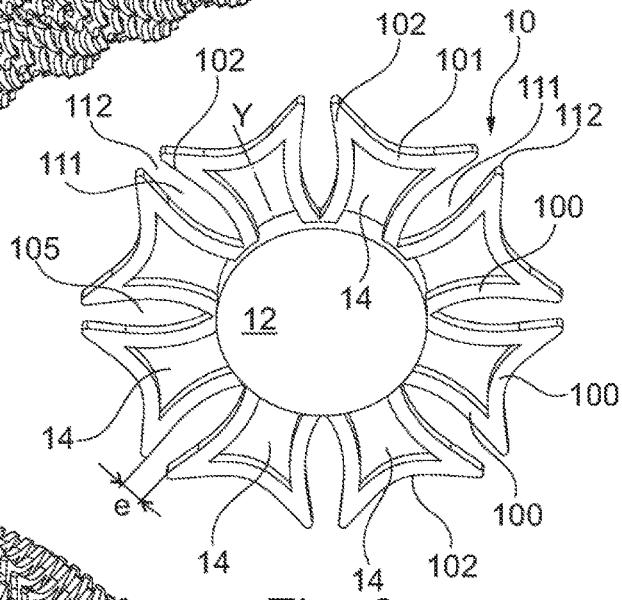
FIG. 9 is a view similar to FIG. 3 of variant embodiments of the element.

The application members 20 of the example in FIG. 9 thus make it possible to collect product in the cavity 14, and also in the recess of the top arch 101.

The teeth 102 favor the catching of the eyelashes on account of their oblique orientation relative to the elongation axis Y. Finally, the relatively small spacing between the adjacent application members 20 also helps the eyelashes to catch, the latter being able to be introduced into the space 111.

In the example illustrated, the lateral arches 100 of two adjacent application members meet at their base. The number of application members 20 is equal to eight.

Figure 10:
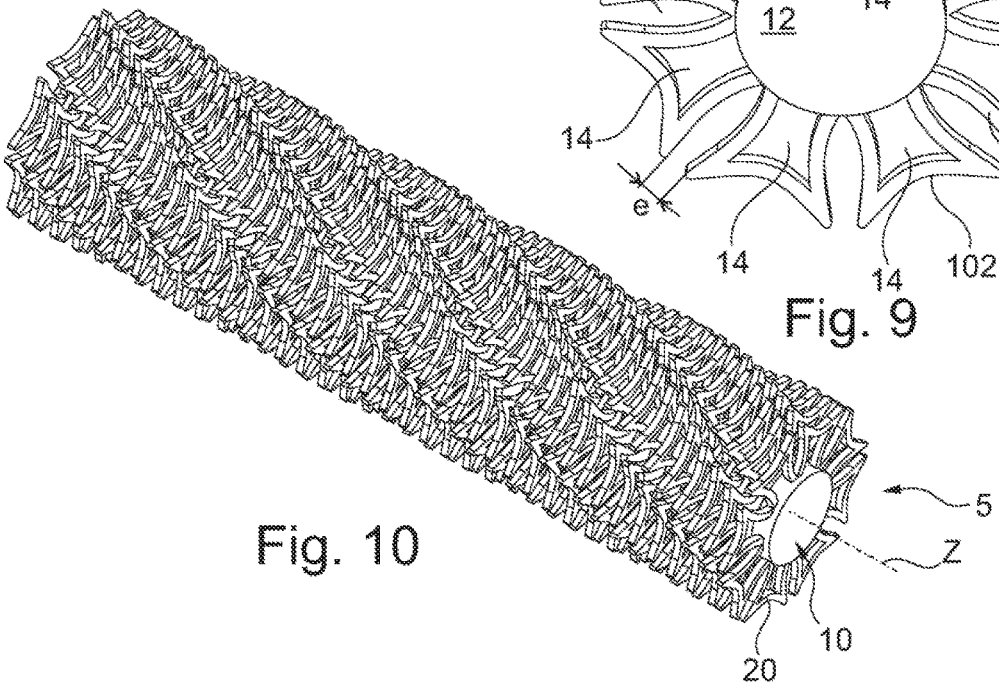
FIG. 10 shows the applicator parts produced with the elements in FIG. 9.

As illustrated in FIG. 10, the elements 10 can be angularly offset on account of the twisting of the core.

Figure 11:
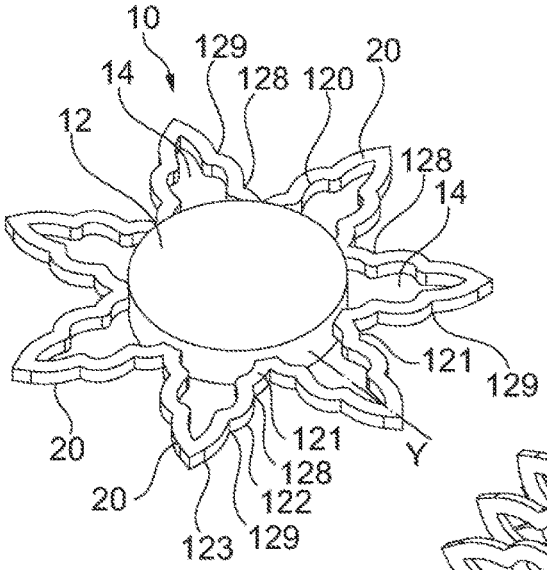
FIG. 11 is a view similar to FIG. 3 of variant embodiments of the element.
Figure 12:
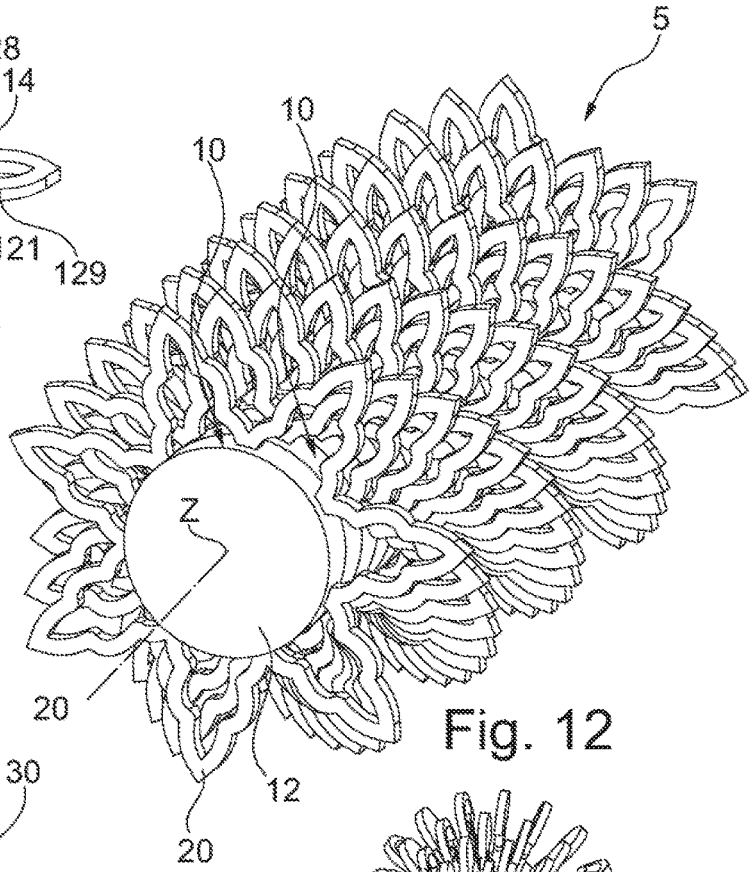
FIG. 12 shows the applicator parts produced with the elements in FIG. 11.

In the example in FIGS. 11 and 12, the hollow application members 20 have the overall shape of an arrowhead, with a strand of material 120 which has a succession of pointed arches that are convex toward the outside, elbows being formed at the meeting points of these arches.

The application members 20 each have a shape that is symmetric with respect to their respective elongation axis Y. The strand of material successively describes, starting from the central part 12, a first arch 121, a second arch 122 and a third arch 123. The two arches 123 meet, forming a tooth at the vertex of the application member 20.

The arches 121 and 122 form, at their meeting point, away from the cavity 14, a recess 128 which can accommodate the composition. The same goes for the arches 122 and 123, which form a recess 129.

In the example in FIG. 11, the hollow application members 20 meet at their base.

The elements 10 can be angularly offset on account of the twisting of the core, as illustrated in FIG. 12.

In the examples which have just been described with reference to FIGS. 3 to 12, the application members each have a flattened shape in the flattening plane of the central part 12, and have a thickness, measured along the axis X of the central part 12, which is less than or equal to the thickness of the latter. The application members can be given a different orientation without departing from the scope of the present invention, as will now be described with reference to FIGS. 13 to 20.

In the examples in these figures, each element 10 has a central part 12 that is thicker than in the above-described examples, and the application members are each in a form flattened in a plane which contains a radius and the axis X of the central part 12.

Figure 13:
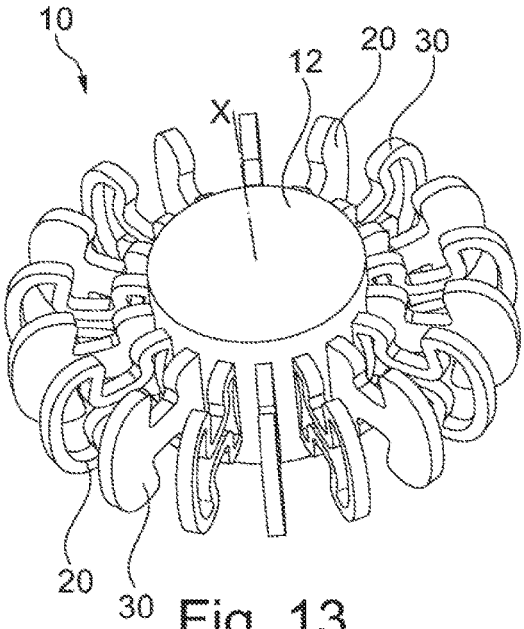
FIG. 13 is a view similar to FIG. 3 of variant embodiments of the element.
Figure 14:
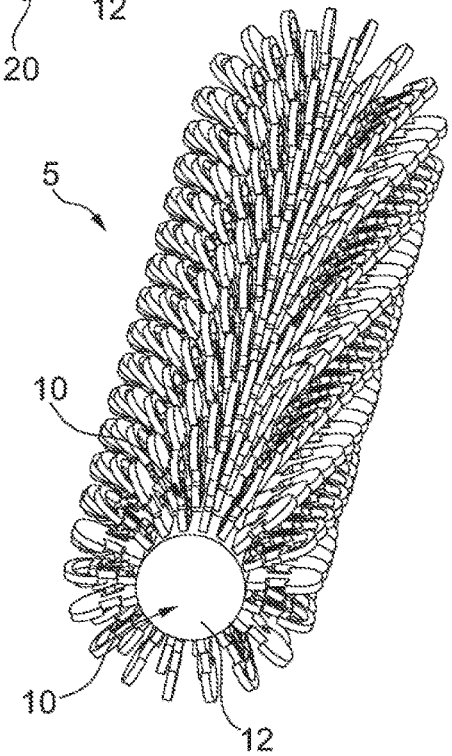
FIG. 14 shows the applicator parts produced with the elements in FIG. 13.

In the example in FIGS. 13 and 14, the elements 10 each have an alternation of hollow application members 20 and solid application members 30 with the same shape as those in the example in FIGS. 2 and 3.

However, in this example, the application members are more numerous and do not meet at their base, the spacing between two consecutive application members in the circumferential direction being for example greater than the thickness of one application member.

The element 10 has for example 18 application members, half of which are hollow.

FIG. 14 illustrates the angular offset between the application members caused by the twisting of the arms 9*a* and 9*b* of the core.

Figure 15:
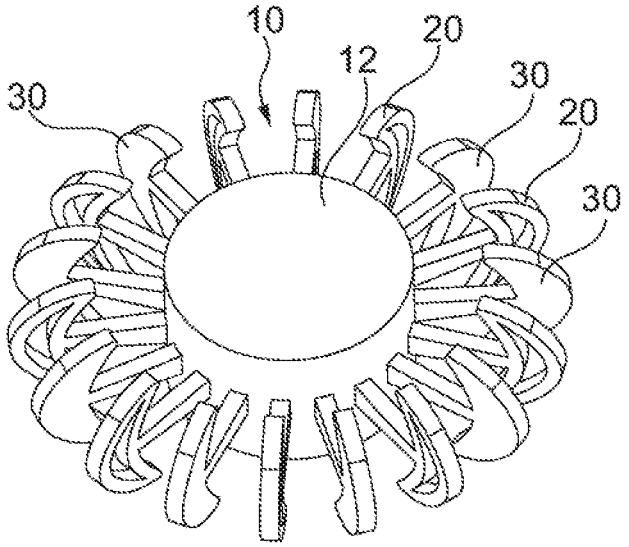
FIG. 15 is a view similar to FIG. 3 of variant embodiments of the element.
Figure 16:
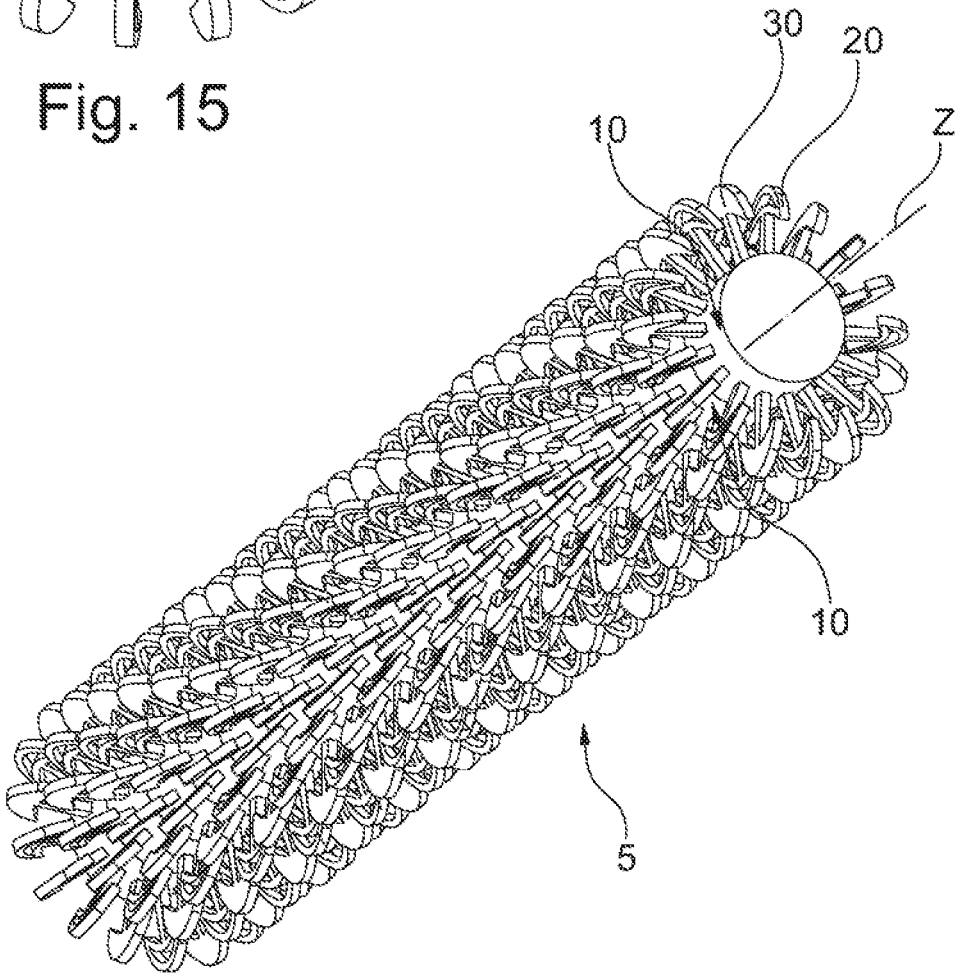
FIG. 16 shows the applicator parts produced with the elements in FIG. 15.

In the example in FIGS. 15 and 16, the application members 20 are identical to those in the example in FIGS. 5 and 6. The disposition thereof on the central part 12 is identical to that in the example in FIG. 13.

Figure 17:
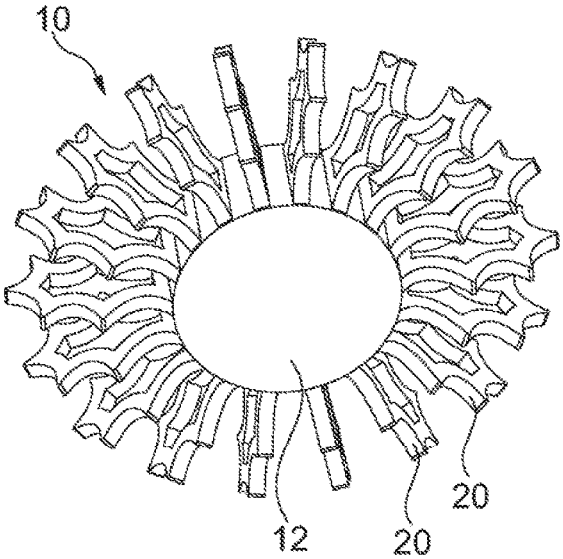
FIG. 17 is a view similar to FIG. 3 of variant embodiments of the element.
Figure 18:
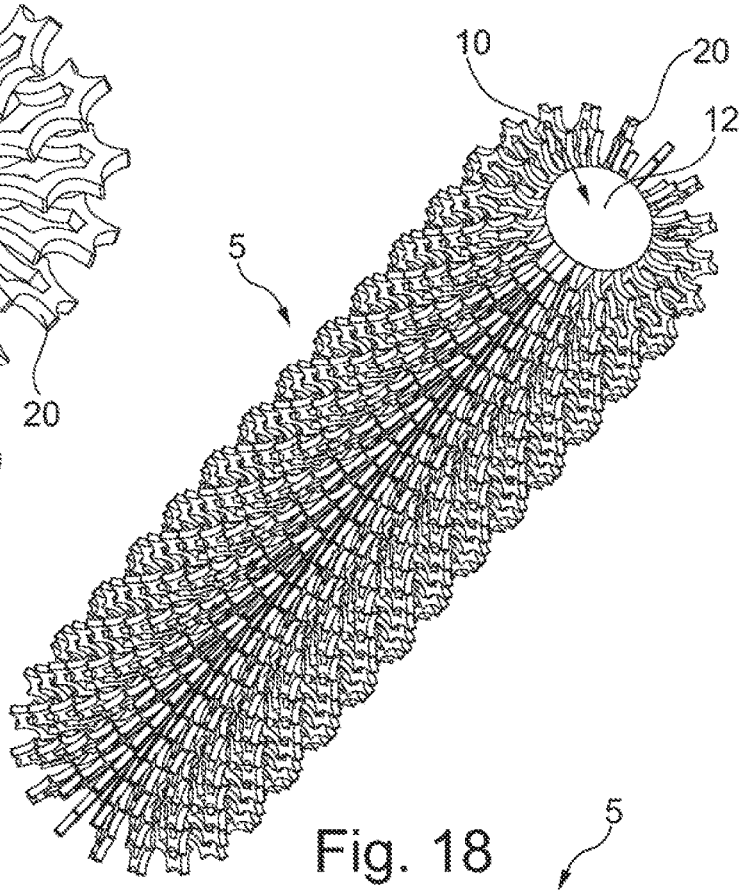
FIG. 18 shows the applicator parts produced with the elements in FIG. 17.
Figure 19:
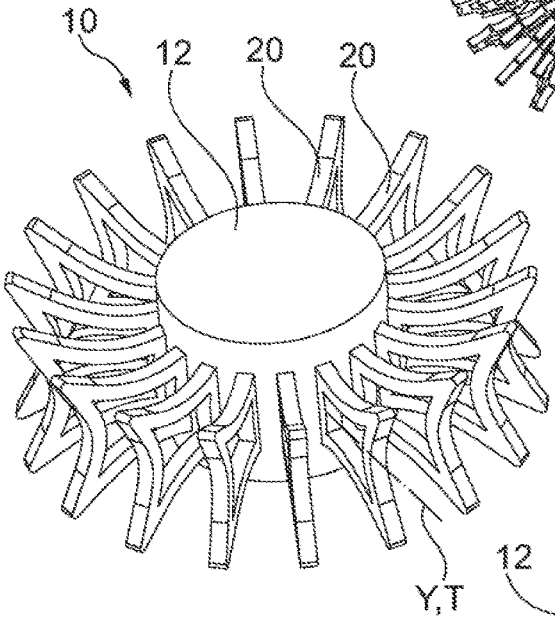
FIG. 19 is a view similar to FIG. 3 of variant embodiments of the element.
Figure 20:
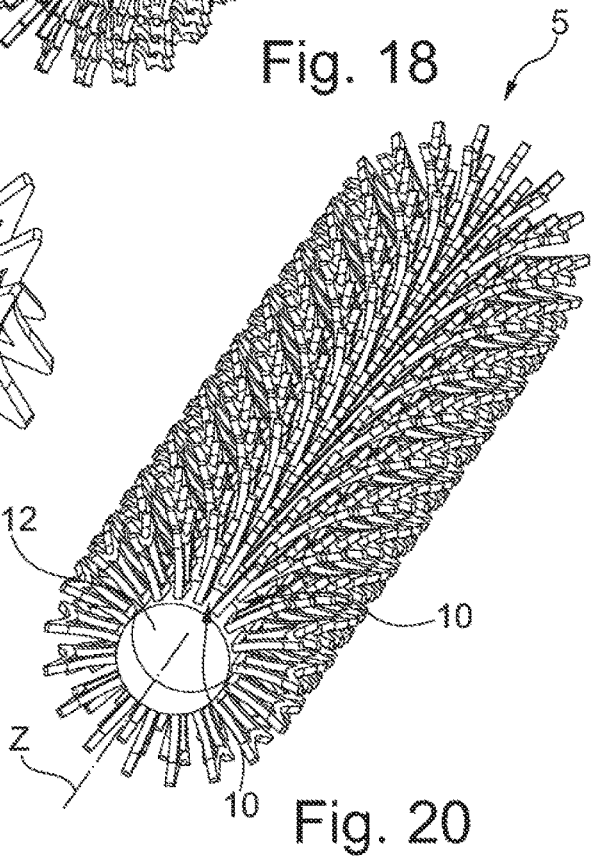
FIG. 20 shows the applicator parts produced with the elements in FIG. 19.

In the example in FIGS. 17 and 18, the application members 20 are identical to those in the example in FIGS. 7 and 8. The disposition thereof on the central part 12 is identical to that in the example in FIG. 13.

In the examples which have just been described, the hollow application members define closed cavities. It is possible to produce the hollow application members with almost closed cavities.

Figure 3A:
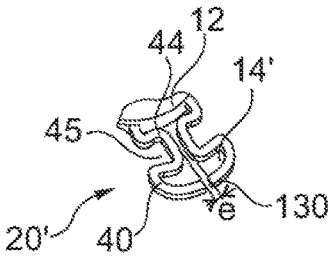
FIG. 3A shows a variant application member, on its own.

By way of example, FIG. 3A shows an example of such a hollow application member 20', the outer contour of which is substantially identical to that of a hollow application member 20 of the example in FIG. 3 apart from an interruption 130 to the strand of material 44, this interruption having a width e less than or equal to 0.3 mm, better still less than or equal to 0.2 mm, even better still less than or equal to 0.1 mm.

The interruption 130 can provide greater flexibility, if necessary allow the eyelash to access the cavity 14' delimited by the strand of material 44, and can also promote the filling of the cavity 14' with the product when the applicator part 5 is in the container.

In the example illustrated, the interruption 130 is positioned at the vertex of the application member, but could be positioned elsewhere, for example at the connection to the central part 12.

Almost closed cavities can also be formed between two adjacent application members of one and the same element 10, when these have portions that are sufficiently close together away from their base.

This is for example the case in the examples in FIGS. 5 to 9, described above, when the gap e between the adjacent application members at for example the enlarged heads 60 or the teeth 86 or 102 is sufficiently small, namely less than or equal to 0.3 mm, better still less than or equal to 0.2 mm, even better still less than or equal to 0.1 mm.

A small gap e can also tend to retain a certain quantity of composition outside the application members, for example in the recess 68 formed between the convex surfaces defining the top of the heads 60 in the example in FIG. 5. This can make it easier for the eyelashes to access the composition with which the applicator part 5 is loaded.

In these examples in FIGS. 5 and 7, at least some of the application members between which these almost closed cavities are formed are hollow.

Variant embodiments without hollow application members 20 will now be described with reference to FIGS. 21 to 28.

Figure 21:
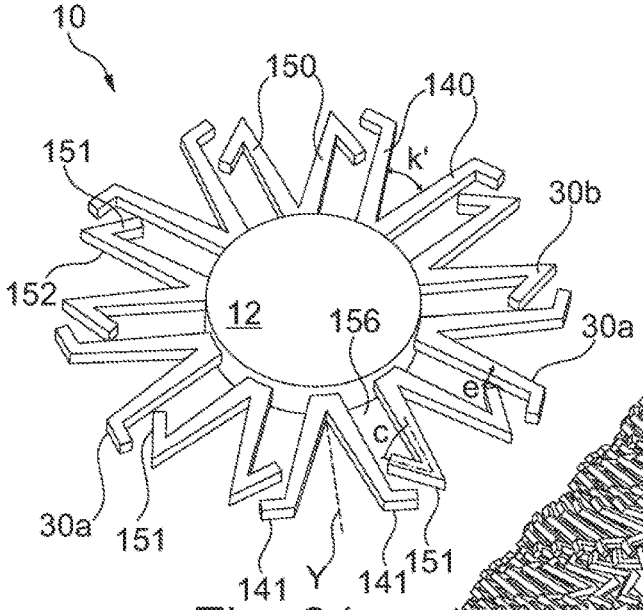
FIG. 21 is a view similar to FIG. 3 of variant embodiments of the element.
Figure 22:
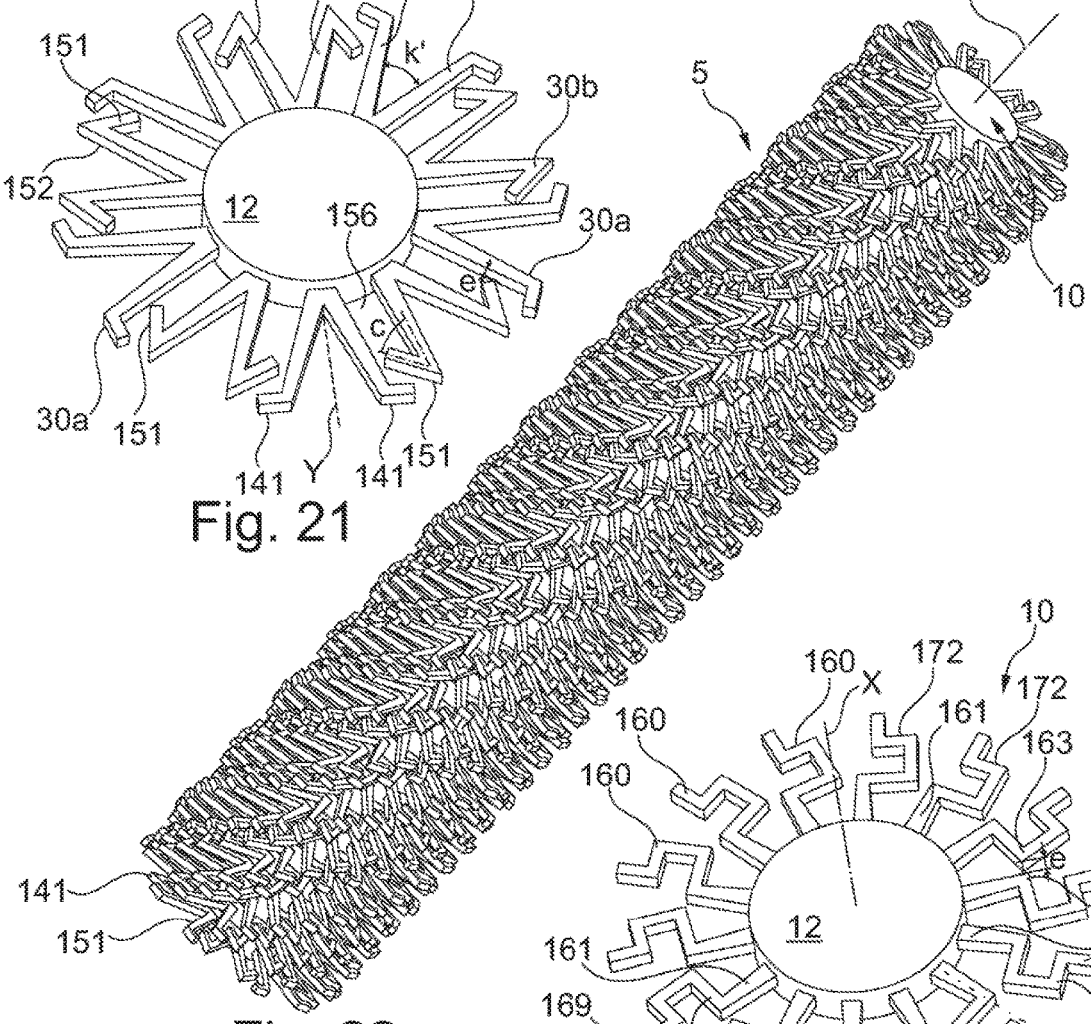
FIG. 22 shows the applicator parts produced with the elements in FIG. 21.

In the example in FIGS. 21 and 22, the element 10 has an alternation of application members 30*a* and 30*b* which follow one another in the circumferential direction around the central part 12.

The application members 30*a* and 30*b* each have the overall shape of a V, with two diverging arms 140 toward the outside for the element 30*a* and two diverging arms 150 for the element 30*b*. The opening angle of the Vs is for example between 15 and 60°, better still between 30 and 45°.

The arms 140 are bent toward the outside at their distal end and have two end portions 141 that are oriented perpendicularly to the elongation axis Y, which is an axis of symmetry for the application member and is coincident with a radius.

The arms 150 are likewise bent at their distal end, but at a greater angle than the arms 140, such that the end portions 151 formed by the elbows each form an acute angle c with the corresponding portion 152 of the arm which is joined to the central part 12.

The arms 140 meet at their base. The same goes for the arms 150.

The application members 30*a* and 30*b* thus each form two reliefs that are able to improve the catching of the eyelashes during make-up application.

Catching is particularly pronounced with the application members 30*b* on account of the orientation of the end portions 151.

In the example illustrated, the gap e between the free end of one portion 151 and the adjacent arm 140 of the neighboring application member 30*a* is small and less than 0.3 mm, better still less than 0.2 mm, even better still less than 0.1 mm, such that two application members 30*a* and 30*b* form, between one another, an almost closed cavity 156 that is able to collect a certain amount of composition.

The portions 141 and 151 can also define, between one another, a space that leads to the outside and contains composition, the latter being able to be retained between said portions on account of its viscosity. This collection of composition at a relatively large radial distance from the central part makes it easier for the eyelashes to access the composition.

Figure 23:
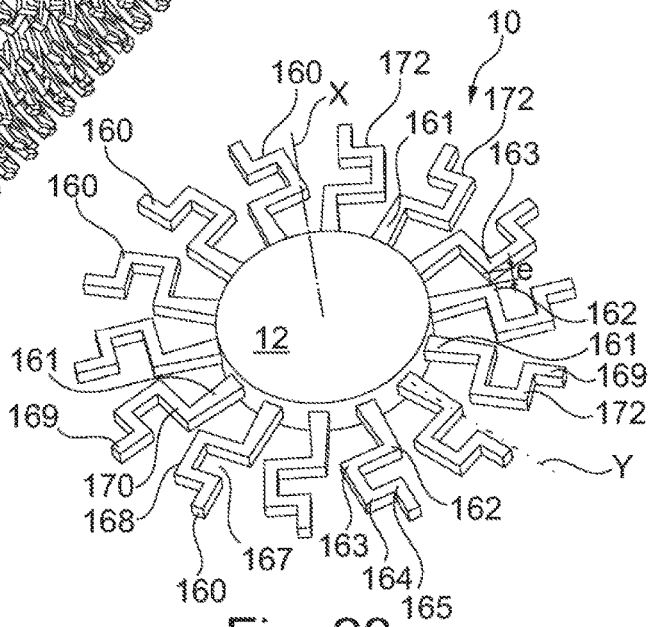
FIG. 23 is a view similar to FIG. 3 of variant embodiments of the element.
Figure 24:
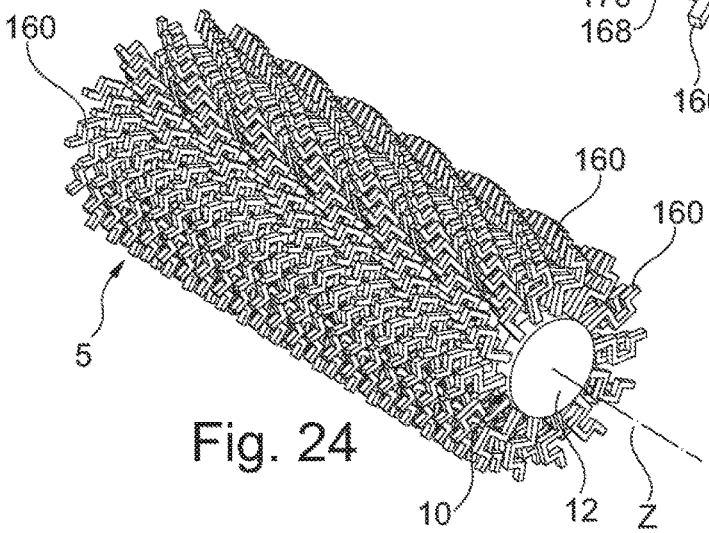
FIG. 24 shows the applicator parts produced with the elements in FIG. 23.

In the example in FIGS. 23 and 24, each element 10 of the applicator part 5 has a succession of identical application members 160, for example 14 thereof.

Each application member 160 has a leg 161 which extends along the elongation axis Y, and has four successive elbows 162 to 165, each at a right angle in the example in question.

The elbow 162 is directed in the clockwise direction, the elbow 163 toward the outside, the elbow 164 in the counterclockwise direction, and the elbow 165 toward the outside.

The elbows 163 and 164 form a groove 167, the bottom of which is defined by a segment 168 of the application member.

The distal portion of the application member is defined by a segment 169 which is parallel to the segment 168 and perpendicular to the segment 170, which forms the elbow 162 with the leg 161.

The segment 169 is offset toward the segment 168 with respect to the leg 161. The gap e between the elbows 162 and 163 of two consecutive application members on the element 10 is relatively small, and is much less than the distance between the legs of these application members and their base.

When the gap e is less than 0.3 mm, better still less than 0.2 mm, even better still less than 0.1 mm, the legs 161 form, with the segment 168 which is directed from one of the application members toward the other, an almost closed cavity 166 in which the composition can collect.

The groove 167 makes it possible to form a reserve of composition radially away from the central part, thereby allowing the eyelashes to be loaded without the latter having to be dipped deeply into the applicator part.

The segment 172 which defines, with the distal segment 169, the elbow 164 also makes it possible to retain the composition on a surface radially away from the central part 12.

Moreover, the notch formed by the succession of elbows 162 to 164 forms a kind of hook that is able to improve the catching of the eyelashes on the applicator part 5.

The distal segments 169 make it possible to benefit from a surface having a high capacity for separating the eyelashes, since they make it easier to introduce the eyelashes between the application members.

Various modifications can be made to this example, notably with regard to the shape of the abovementioned groove, which may be V-shaped in one variant, in which case the number of elbows is reduced to three. In other variants, the number of elbows is higher.

Figure 25:
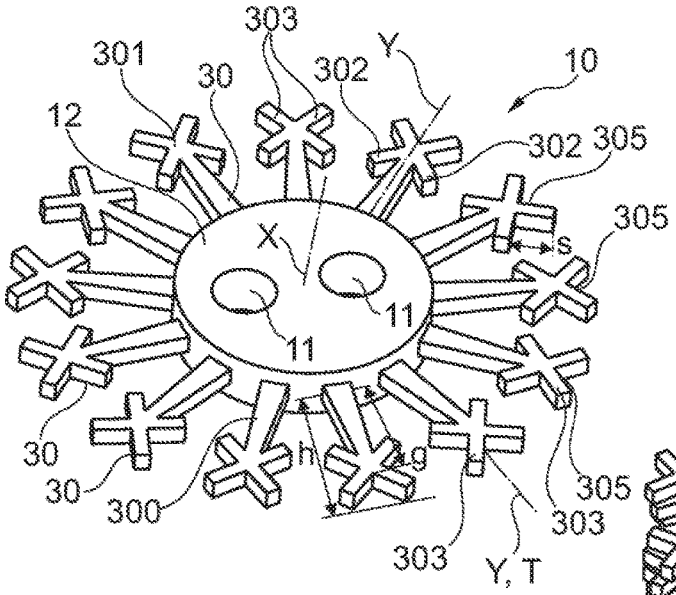
FIG. 25 is a view similar to FIG. 3 of variant embodiments of the element.
Figure 26:
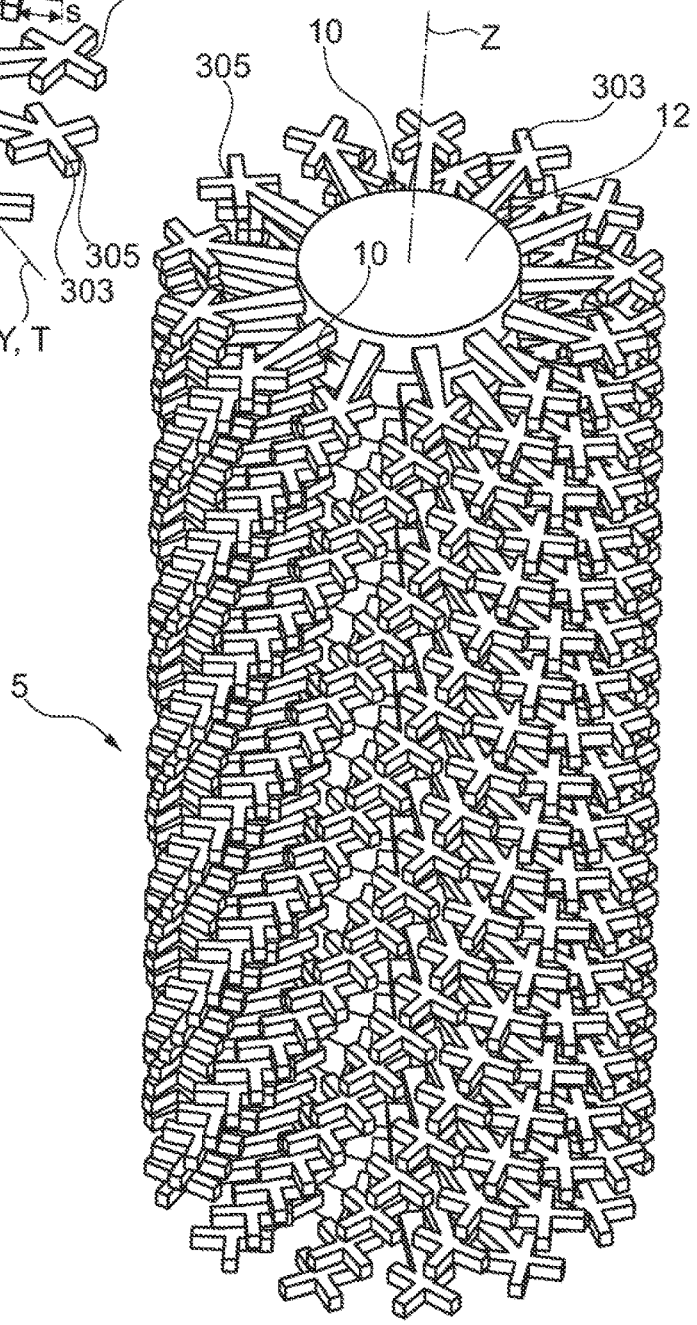
FIG. 26 shows the applicator parts produced with the elements in FIG. 25.

A variant embodiment of the applicator part 5 will now be described with reference to FIGS. 25 and 26.

In this example, the element 10 only has solid application members 30.

Each application member 30 has a radial arm 300, provided at its end with an X-shaped head 301, having two inner arms 302 that are oriented at 90° to one another toward the central part 12, and two outer arms 303 that are oriented at 90° to one another toward the outside.

The center of the X is situated on the elongation axis Y of the application member 30.

The length s of the arms 302 and 303 is for example between 0.1 and 3 mm, this length being able to be identical or different for the different arms of the head 301.

In the example in question, the arms 302 and 303 extend at an angle of about 45° to the elongation axis.

The inner arms 302 form hooks suitable for gripping the eyelashes introduced into the applicator part. Their reentrant orientation makes it possible to readily catch the eyelashes.

The outer arms 303 define an elbow at their meeting point and a cavity 305 that is open toward the outside, in which the composition can collect by surface tension while remaining easily accessible for the eyelashes. The bottom of the cavity 305 is situated at a distance q from the central part 12 of for example between 0.5 and 7.5 mm, better still between 1 and 6 mm.

The ratio q/h, where h is the total height of the application member, is preferably greater than or equal to 25%, better still greater than or equal to 50%.

The elements 10 can be angularly offset about the longitudinal axis Z of the core, on account of the twisting of the latter.

Figure 27:
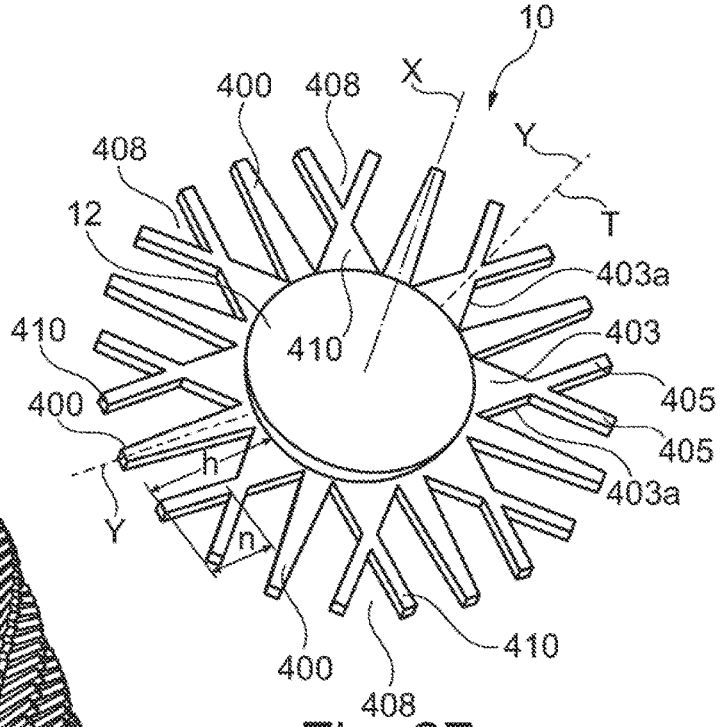
FIG. 27 is a view similar to FIG. 3 of variant embodiments of the element.

The element 10 shown in FIG. 27 has an alternation of application members 400 and 410 in the circumferential direction, about the central part 12.

The application members 400 are constituted of radial arms having a cross section that decreases toward their free end, the elongation axis Y of which is coincident with a radius.

The application members 410 have an enlarged base 403 with a triangular shape when viewed along the axis X of the central part 12, said enlarged base 403 meeting the base of the adjacent radial arms 400 at the central part 12.

Two V-shaped arms 405 are attached to the vertex of the base 403, these arms 405 extending in continuation of the sides 403*a* of the base 403 and forming at their meeting point an elbow and between one another a cavity 408 that is open toward the outside. The arms 405 extend symmetrically to one another with respect to the elongation axis Y.

The depth n of this cavity, measured along the elongation axis Y, is for example greater than or equal to 0.1 mm, better still greater than or equal to 0.5 mm.

The ratio n/h, where h denotes the total height of the application member, is for example between 25% and 50%.

The distance h-n from the bottom of the cavity 408 to the surface of the central part 12 is for example between 1.9 mm and 7.9 mm, better still between 1.5 mm and 4 mm.

The composition can collect in the cavity 408 at a nonzero radial distance from the surface of the central part 12.

Figure 28:
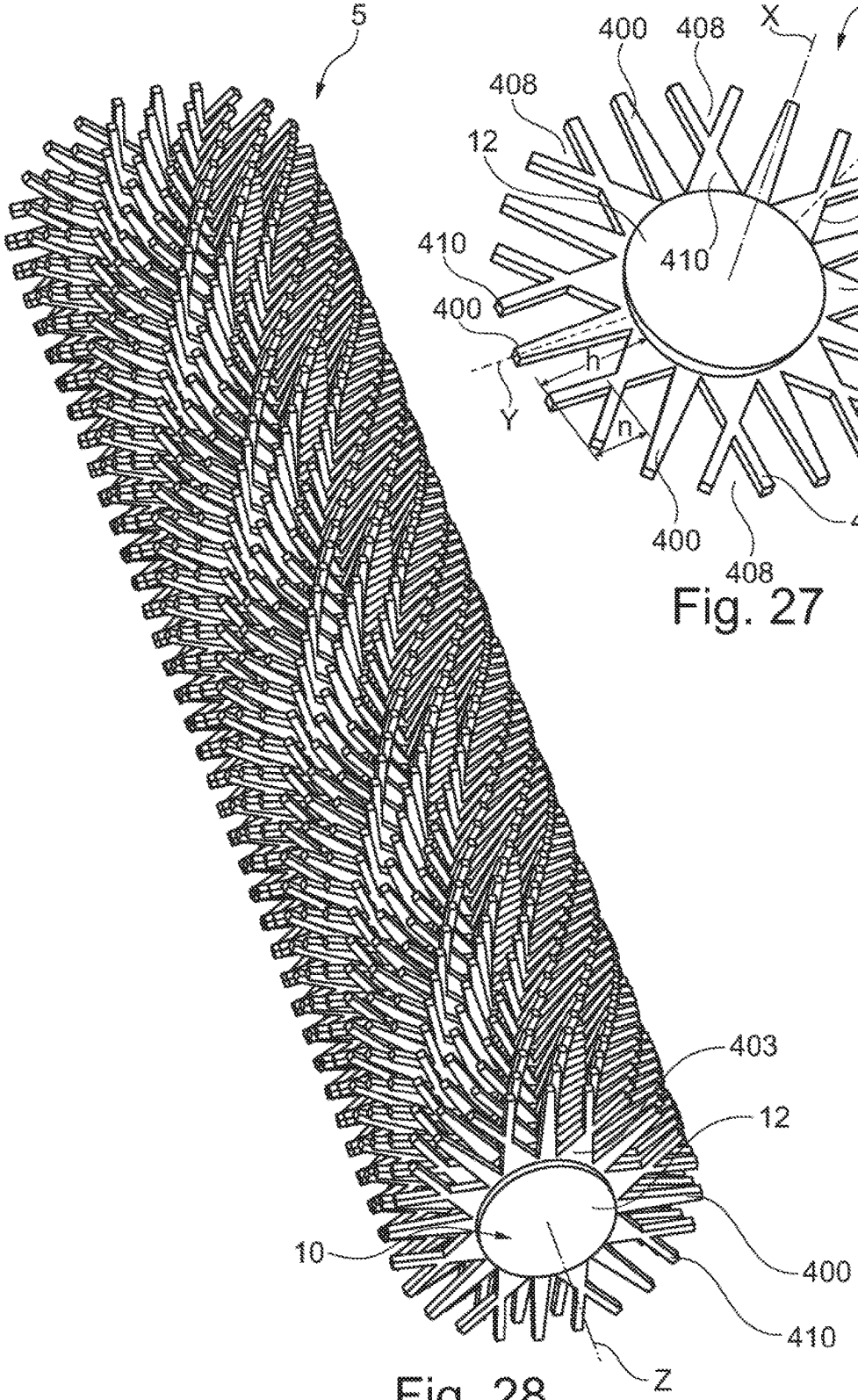
FIG. 28 shows the applicator parts produced with the elements in FIG. 27.

FIG. 28 illustrates the angular offset between the elements 10 on account of the twisting of the core.

Figure 29:
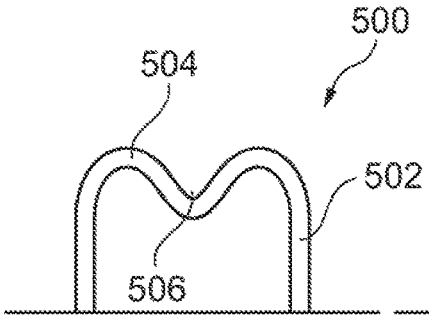
FIG. 29 shows an embodiment of the application member.

FIG. 29 shows an application member 500 that comprises a strand of material that forms a loop. The strand of material comprises two lateral legs 502 that are joined by a top arm 504 at their distal end. The top arm 504 comprises an undulated form that forms a cavity 506 in which the product can accumulate. The undulated form defines at least one elbow.

Figure 30:
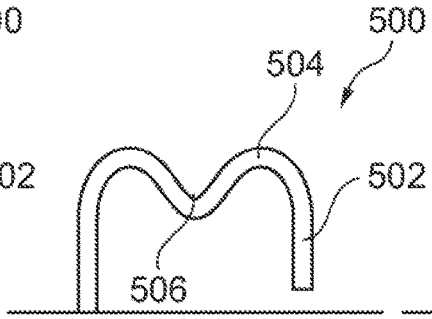
FIG. 30 shows an embodiment of the application member.
Figure 31:
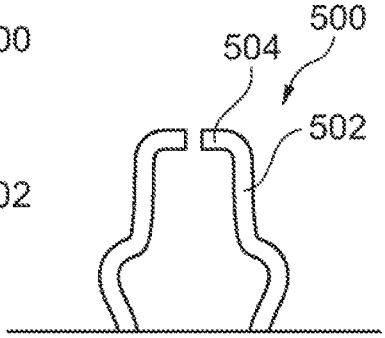
FIG. 31 shows an embodiment of the application member.

The embodiment of FIG. 30 differs from the embodiment of FIG. 29 in that the strand of material forms an unclosed loop. In the illustrated example, the loop is open at one of its junctions to the core. In a variant, the loop is open anywhere else on the strand of material, for example in the top arm as illustrated in FIG. 31.

In the embodiment of FIG. 29, the lateral legs 502 are straight. However, as illustrated on FIG. 31, they could have an undulated form. In this case, the top arm could not be in an undulated form.

Figure 32:
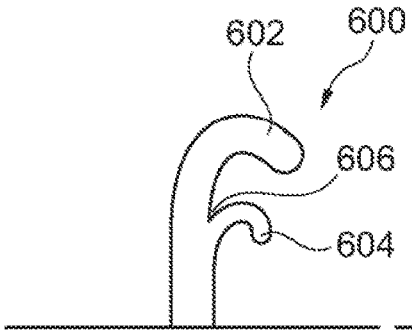
FIG. 32 shows an embodiment of the application member.

FIG. 32 displays a further embodiment in which the strand of material 600 comprises a hook 602 at its extremity and a protruding relief 604 on its side. The hook defines an elbow and the hook and the protruding relief define a surface 606 that can accumulate product.

Figure 33:
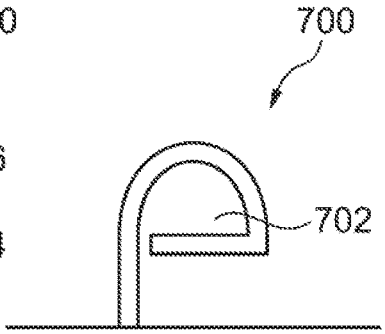
FIG. 33 shows an embodiment of the application member.

FIG. 33 displays an application member 700 has a P form, the loop of the P 702 being unclosed. In the loop of the P 702 define an elbow and the product can accumulates therein.

Figure 34:
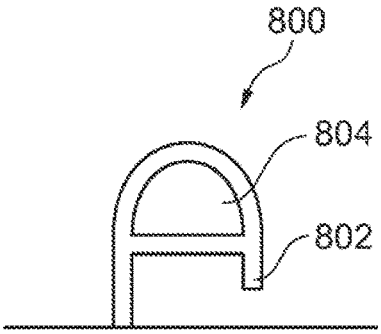
FIG. 34 shows an embodiment of the application member.

The embodiment of FIG. 34 differs from the embodiment of FIG. 33 in application member 800 is in the form of an A with a short leg 802 that is not connected to the core. The loop of the A 804 is closed or not. The loop of the A 804 could be hollow or not. The short leg 802 and the loop 804 form between them an elbow that can accumulated product.

Figure 35:
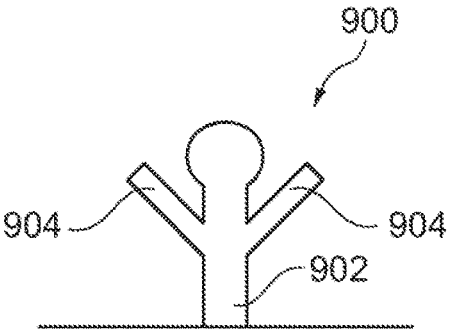
FIG. 35 shows an embodiment of the application member.

FIG. 35 displays an application member 900 comprising a central arm 902 and two lateral arms 904 extending from the central arm. The extremity of the central arm 902 is enlarged. The lateral arms 904 and the central arm 902 define between them an elbow that can accumulate product.

Figure 36:
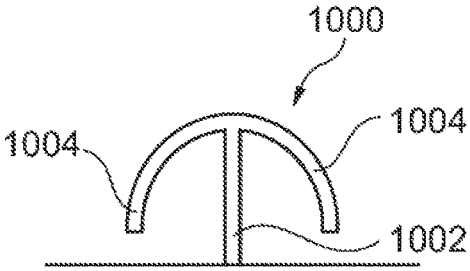
FIG. 36 shows an embodiment of the application member.

FIG. 36 illustrated an application member 1000 that comprises a central arm 1002 and two lateral arms 1004 extending from the extremity of the central arm 1002. The application member 1000 can have the form of a mushrooms. The lateral arms 1004 and the central arm 1002 define between them an elbow that can accumulate product.

Of course, the invention is not limited to the examples that have just been described. For example, the number of application members may be different in each of the examples.

It is possible to stack on the core elements 10 which are not identical, being made for example of different materials, notably with different hardnesses, and/or having application members with different shapes.

The core can be given a curvature, such that the applicator part extends along a curved longitudinal axis.

The hollow application members can be given yet other shapes, and notably they can be produced with at least one bridge of material on the inside to form two interior cavities.

The invention claimed is:

1. An applicator for applying a cosmetic composition to eyelashes or eyebrows, comprising:

a core extending along a longitudinal axis, at least one element attached to the core, each element comprising a central part fitted onto the core and at least one application member carried by the central part, each of the at least one application members having a maximal width, measured in a plane perpendicularly to said longitudinal axis of the core, being larger than the maximum thickness of the application member, measured along the longitudinal axis of the core, this application member comprising a strand of material comprising at least one elbow that defines a composition collection surface, the elbow being a change in direction of the strand of material, wherein:

the strand of material is joined to the central part by a leg, the strand of material having exactly four elbows, a first elbow at a right angle, a second elbow at a right angle away from the center of the at least one application member, a third elbow at a right angle toward a elongation axis of the leg, and a fourth elbow at a right angle toward the outside, a distal portion of the at least one application member being straight and eccentric with respect to the elongation axis of the leg, or the strand of material having exactly two lateral legs and a top arm joining the two lateral legs at a distal end. the top arm comprising an undulated form defining elbows, the two lateral legs extending radially, one of the two lateral legs being linked to the central part, the other of the two lateral legs being spaced apart from the central part, or the strand of material forming an enlarged head portion linked to a base portion by a stem portion, the width of the stem portion perpendicular to an elongation axis of the application member being less than the width of the head portion and the width of the base portion, the stem portion forming between the head portion and the base portion, on an outside, a U-shaped groove on each side of the elongation axis, the width of the head portion begin wider than the width of the base portion, or the strand of material is deprived of free end and comprises at least two elbows, each of said at least two elbows being formed by a pointed part at the meeting point of curved parts of the strand of material, each of said curved parts being only concave or convex, each of the pointed part extending along a direction forming a non-zero angle with a tangent at the level of the pointed part of a circle passing by the pointed part and having its center at the level of a center of the central part.

2. The applicator as claimed in claim 1, wherein the strand of material forms at least one concavity that is open away from the center of the at least one application member and situated at a non-zero radial distance from the central part.

3. The applicator as claimed in claim 2, wherein the strand of material describes, starting from the central part, a first elbow of the at least one elbow for forming the base portion, which is continued by a portion defining the U-shaped groove.

4. The applicator as claimed in claim 1, wherein in the strand of material that is deprived of the free end, said portion is attached to an arch which forms a top of an enlarged head of the at least one application member.

5. The applicator as claimed in claim 1, wherein in the strand of material that is deprived of the free end, the at least one application member having an enlarged head comprising two arches that form elbows at their meeting point, one of the arches defining a composition collection surface.

6. The applicator as claimed in claim 1, wherein in the strand of material that is deprived of the free end, the strand of material of the at least one application member having a toothed shape, comprising a succession of pointed arches that are concave away from the center of the at least one application member.

7. The applicator as claimed in claim 1, wherein in the strand of material that is deprived of the free end, the at least one application member having two lateral arms that are joined at their end by an arch, forming elbows.

8. The applicator as claimed in claim 1, wherein in the strand of material that is deprived of the free end, the at least one application member is in the shape of an arrowhead, the strand of material comprising a succession of pointed arches that are convex away from the center of the at least one application member.

9. The applicator as claimed in claim 1, wherein at least one of the at least one element has a plurality of application members, the elongation axes of the application members of the element are coplanar.

10. The applicator as claimed in claim 1, wherein at least one of the at least one application member of one of the at least one element is flattened in a plane.

11. The applicator as claimed in claim 1, wherein at least one of the at least one element has a plurality of application members, the application members of the at least one element have their flattening plane oriented in a plane containing the axis of the central part in which the flattening plane is a plane that the application members are flattened.

12. The applicator as claim in claim 1, wherein the at least one elbow is a portion of variable curvature on the strand of material.

13. A packaging and application device comprising:

a container containing a composition to be applied, and an applicator as claimed in claim 1.

14. A method for a cosmetic treatment of eyelashes and/or eyebrows, notably for making them up, comprising the step of applying a cosmetic composition to the eyelashes with the aid of an applicator as claimed in claim 1.

* * * * *